US005288604A

United States Patent [19]

Mihara et al.

[11] Patent Number: 5,288,604

[45] Date of Patent: Feb. 22, 1994

[54] SILVER HALIDE PHOTOGRAPHIC MATERIAL AND METHOD FOR DEVELOPING THE SAME

[75] Inventors: Yuji Mihara; Takashi Kato; Takanori Hioki, all of Kanagawa, Japan

[73] Assignee: Fuji Photo Film Co., Ltd., Kanagawa, Japan

[21] Appl. No.: 876,380

[22] Filed: Apr. 30, 1992

[30] Foreign Application Priority Data

May 10, 1991 [JP] Japan ..... 3-133221

[51] Int. Cl.[5] ..... G03C 1/02

[52] U.S. Cl. ..... 430/584; 430/401; 430/416; 430/510; 430/523; 430/586; 430/600; 430/944; 430/963

[58] Field of Search ..... 430/944, 586, 600, 963, 430/401, 510, 523, 584, 416

[56] References Cited

U.S. PATENT DOCUMENTS 3,647,460 3/1972 Hofman et al. ..... 96/66
4,536,473 8/1985 Mihara ..... 430/575
5,153,112 10/1992 Yoshida et al. ..... 430/428

*Primary Examiner*—Thorl Chea
*Attorney, Agent, or Firm*—Sughrue, Mion, Zinn, Macpeak & Seas

[57] ABSTRACT

A silver halide photographic material is disclosed, comprising at least one sensitizing dye represented by formula (I):

(I)

wherein $V_1$, $V_2$, $V_3$, $V_4$, $V_5$ and $V_6$ each represents a substituent with the total of the Hammett's constants of all the substituents being less than −0.27, $R_1$ and $R_2$ each represents an alkyl group, $L_1$, $L_2$, $L_3$, $L_4$, $L_5$, $L_6$ and $L_7$ each represents a methine group, m represents 0 or 1, Z represents an atomic group necessary for forming a 5-membered or 6-membered nitrogen-containing hetero ring, $X_n$ represents a charge balancing counter ion(s), n has a value of at least 0 which is necessary for neutralizing the charge of the compound. The material has a high sensitivity to infrared rays and gives an image of high quality with little remaining color. Also disclosed is a method for processing such a silver halide photographic material.

13 Claims, No Drawings

SILVER HALIDE PHOTOGRAPHIC MATERIAL AND METHOD FOR DEVELOPING THE SAME

FIELD OF THE INVENTION

The present invention relates to a silver halide photographic material which has been color-sensitized to infrared rays and, in particular, to a material which has a high sensitivity in the infrared spectral range and may be used to form an image of a high quality with little remaining color (i.e., residual color).

BACKGROUND OF THE INVENTION

One means of exposing photographic materials is a known image forming method using a so-called scanner system. An original is scanned and a silver halide photographic material is exposed on the basis of the resulting image signal so as to form a negative image or positive image corresponding to the image of the original thereon.

There are various practical recording devices which may be used in such a scanner system image forming method. The recording light sources for scanner system recording devices include a glow lamp, a xenon lamp, a mercury lamp, a tungsten lamp and a light emitting diode. However, all these light sources have the drawbacks that the output is weak and their life is short. To compensate for these drawbacks, there are known scanners which use coherent laser rays, such as a Ne-He laser, an argon laser or a He-Cd laser, as the light source for the scanning system. The coherent laser rays may yield a high output, but they have other drawbacks in that they need large-sized, high-priced devices and modulators. In addition, since visible rays are used, the safelight for the photographic materials is limited and the handlability of the devices is poor.

In contrast, devices for semiconductor lasers are small-sized and low-priced and may be easily modulated. In addition, semiconductor lasers have a longer life than the above-mentioned lasers. Moreover, since they emit infrared rays, a light safelight may be used in handling infrared-sensitive photographic materials. Therefore, semiconductor lasers are advantageous with respect to handlability and operability. Despite these advantages, since there are unknown excellent photographic materials having high infrared sensitivity and good storage stability, the excellent characteristics of these semiconductor lasers could not be utilized satisfactorily.

In one known technology for producing photographic materials, cyanine dyes of a certain kind are added to silver halide photographic materials so as to extend their light-sensitive range on the side of a longer wavelength. This is a so-called spectral sensitizing technology. It is also known that the spectral sensitizing technology may apply not only to rays of a visible range, but also to those of an infrared range. For infrared sensitization, sensitizing dyes capable of absorbing infrared rays are used, which are described in, for example, Mees, *The Theory of the Photographic Process*, 3rd Ed. (published by MacMillan, 1966), pages 198 to 201. In that case, the photographic materials desirably have a high sensitivity to infrared rays and a small variation in sensitivity, even during storage of the emulsions. For this purpose, various sensitizing dyes have heretofore been developed.

For instance, many sensitizing dyes are described in U.S. Pat. Nos. 2,095,854, 2,095,856, 2,955,939, 3,482,978, 3,552,974, 3,573,921 and 3,582,344. However, even though these sensitizing dyes are used, the sensitivity and storage stability of the photographic materials to which they are added could not be said to be fully sufficient.

On the other hand, it is also known that addition of a second specifically selected organic compound of a certain kind to the photographic materials, in addition to spectral sensitizing dyes, noticeably increases the spectral sensitivity of the materials; and the effect to be attained by the addition is known as a supersensitizing effect.

For supersensitization in the infrared range, JP-A-59-191032, JP-A-59-192242 and JP-A-60-80841 (the term "JP-A" as used herein means an "unexamined published Japanese patent application") describe the combination of infrared sensitizing dyes (tricarbocyanine dyes, 4-quinolinedicarbocyanine dyes) and cyclic onium salt compounds or heterocyclic compounds of certain kinds.

In accordance with the proposals in these patent publications, the infrared sensitivity and the storage stability of photographic materials can surely be improved. However, other techniques for obtaining even higher infrared sensitivity without lowering storage stability are desired.

On the other hand, the image quality of the images obtained by scanning exposure is not always satisfactory at least at present, and further improvement in their image quality is desired.

In addition, the speed of processing photographic materials with automatic developing machines has been elevated recently. In such rapid processing, however, the time necessary for fully decoloring the dyes in the photographic materials processed could not always be ensured so that the processed materials often have trouble due to remaining color therein.

SUMMARY OF THE INVENTION

One object of the present invention is to provide a silver halide photographic material having a high sensitivity to infrared rays.

Another object of the present invention is to provide a silver halide photographic material for infrared scanning exposure, which has a high sensitivity to infrared rays and which may form an image of high quality.

Still another object of the present invention is to provide a silver halide photographic material having a high sensitivity to infrared rays and causing little remaining color after processing.

These and other objects of the present invention have been attained by a silver halide photographic material containing at least one sensitizing dye represented by formula (I):

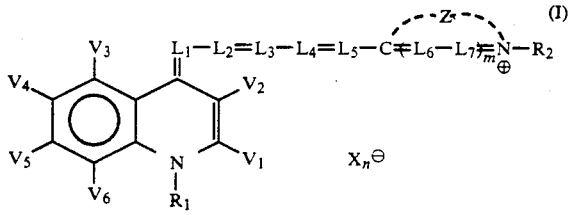

(I)

wherein $V_1$, $V_2$, $V_3$, $V_4$, $V_5$ and $V_6$ each represents a substituent satisfying the condition of:

$Y = \sigma p1 + \sigma p2 + \sigma p3 + \sigma p4 + \sigma p5 + \sigma p6 < -0.27$, and Hammett's $\sigma p$ value of each being $\sigma pi$ with i being from 1 to 6;

$R_1$ and $R_2$ may be the same or different and each represents an alkyl group;

$L_1$, $L_2$, $L_3$, $L_4$, $L_5$, $L_6$ and $L_7$ each represents a methine group, and m represents 0 or 1;

Z represents an atomic group necessary for forming a 5-membered or 6-membered nitrogen-containing hetero ring; and $X_n$ represents a charge balancing counter ion(s), and n has a value of at least 0 which is necessary for neutralizing the charge of the compound.

In one embodiment of the present invention, a silver halide photographic material for infrared scanning exposure, which has at least one silver halide emulsion layer containing at least one sensitizing dye represented by formula (I), has a light-insensitive hydrophilic colloid layer having an optical density of at least 0.5 or more at a wavelength of 780 nm on the side opposite the support from the emulsion layer of containing the dye and/or between the support and the emulsion layer.

DETAILED DESCRIPTION OF THE INVENTION

The term "$\sigma p$" as referred to herein indicates the value as defined in *Chemical Region*, "Structure Activity Correlation of Drugs—Guide to Studies on Effects and Mechanisms of Drug Designs", Extra Issue No. 122 (edited by Society of Discussion on Structure Activity Correlation, Japan, published by Nanko-do Publishing Co.), pages 96 to 103; and Corwin Hansch & Albert Leo, *Substituent Constants for Correlation Analysis in Chemistry and Biology* (published by John Wiley & Sons Co.), pages 69 to 161. For substituents other than those mentioned in these literature, their $\sigma p$ values may be measured by the method described in *Chemical Reviews*, Vol. 17, pages 125 to 136 (1935).

$V_1$, $V_2$, $V_3$, $V_4$, $V_5$ and $V_6$ each represents, for example, a hydrogen atom, a halogen atom (e.g., chlorine, fluorine, bromine), an unsubstituted alkyl group, more preferably an unsubstituted alkyl group having 10 or less carbon atoms (e.g., methyl, ethyl), a substituted alkyl group, more preferably a substituted alkyl group having 18 or less carbon atoms (e.g., benzoyl, α-naphthylmethyl, 2-phenylethyl, trifluoromethyl), an acyl group, more preferably an acyl group having 10 or less carbon atoms (e.g., acetyl, benzoyl, mesyl), an acyloxy group, preferably an acyloxy group having 10 or less carbon atoms (e.g., acetyloxy), an alkoxycarbonyl group, more preferably an alkoxycarbonyl group having 10 or less carbon atoms (e.g., methoxycarbonyl, ethoxycarbonyl, benzyloxycarbonyl), a substituted or unsubstituted carbamoyl group (e.g., carbamoyl, N,N-dimethylcarbamoyl, morpholinocarbonyl, piperidinocarbonyl), a substituted or unsubstituted sulfamoyl group (e.g., sulfamoyl, N,N-dimethylsulfamoyl, morpholinosulfonyl, piperidinosulfonyl), a carboxyl group, a cyano group, a hydroxyl group, an amino group, an acylamino group, more preferably an acylamino group having 8 or less carbon atoms (e.g., acetylamino), an alkoxy group, more preferably an alkoxy group having 10 or less carbon atoms (e.g., methoxy, ethoxy, benzoyloxy), an alkylthio group (e.g., ethylthio), an alkylsulfonyl group (e.g., methylsulfonyl), a sulfonic acid group, an aryloxy group (e.g., phenoxy), or an aryl group (e.g., phenyl, tolyl).

Preferably, they are each a hydrogen atom, an unsubstituted alkyl group, more preferably an unsubstituted alkyl group having 10 or less carbon atoms (e.g., methyl, ethyl), a substituted alkyl group, more preferably a substituted alkyl group having 18 or less carbon atoms (e.g., benzoyl α-naphthylmethyl, 2-phenylethyl, trifluoromethyl), a hydroxyl group, an amino group, an alkoxy group, more preferably an alkoxy group having 10 or less carbon atoms (e.g., methoxy, ethoxy, benzoyloxy), or an aryloxy group (e.g., phenoxy).

Y is preferably such that two or more of the substituents each have a $\sigma pi$ of less than 0; and the substituents are preferably a lower alkyl group (preferably having 1 to 8 carbon atoms) and an alkoxy group (preferably having 1 to 8 carbon atoms).

More preferably, at least $V_4$ and $V_5$ are substituents each having a $\sigma pi$ of less than 0; and the substituents are preferably a lower alkyl group (preferably having 1 to 8 carbon atoms) and an alkoxy group (preferably having 1 to 8 carbon atoms). Most preferably, $V_1$, $V_2$, $V_3$ and $V_6$ are all hydrogens.

The groups represented by $R_1$ and $R_2$ may be the same or different and each represents an alkyl group (preferably having from 1 to 8 carbon atoms, such as methyl, ethyl, propyl, butyl, pentyl, heptyl), or a substituted alkyl group. In the substituted alkyl groups, the alkyl moiety preferably has 6 or less carbon atoms and is substituted by one or more substituents selected from, for example, a carboxyl group, a sulfo group, a cyano group, a halogen atom (e.g., fluorine, chlorine, bromine), a hydroxyl group, an alkoxycarbonyl group (having 8 or less carbon atoms, such as methoxycarbonyl, ethoxycarbonyl, benzyloxycarbonyl), an alkoxy group (having 7 or less carbon atoms, such as methoxy, ethoxy, propoxy, butoxy, benzyloxy), an aryloxy group (e.g., phenoxy, p-tolyloxy), an acyloxy group (having 3 or less carbon atoms, such as acetyloxy, propionyloxy), an acyl group (having 8 or less carbon atoms, such as acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl), and an aryl group (e.g., phenyl, p-hydroxyphenyl, p-carboxyphenyl, p-sulfophenyl, α-naphthyl). Preferably, the substituents are an unsubstituted alkyl group (e.g., methyl, ethyl, n-propyl), a carboxyalkyl group (e.g., 2-carboxyethyl), or a sulfoalkyl group (e.g., 2-sulfoethyl, 3-sulfopropyl, 4-sulfobutyl, 3-sulfobutyl).

The terms $L_1$, $L_2$, $L_3$ and $L_4$ each represents a methine group or a substituted methine group. The substituted methine group may be substituted by substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperazino) and/or an alkylthio group (e.g., methylthio, ethylthio). They may form a ring with the other methine group(s) or may form a ring with any other auxochrome(s).

$L_1$ is preferably a hydrogen atom or forms a ring with $V_2$.

$L_2$ and $L_4$ each is preferably a hydrogen atom or each forms a 5-membered or 6-membered ring with $L_4$ and $L_5$, respectively.

$L_3$ is preferably a hydrogen atom, a lower alkyl group (preferably having 1 to 8 carbon atoms), a benzyl group or an aryl group (particularly preferably 6 to 12 carbon atoms); and $L_5$ is preferably a hydrogen atom or forms a ring with $R_2$.

More preferably, $L_1$, $L_2$, $L_4$ and $L_5$ are all hydrogen atoms, and $L_3$ is a lower alkyl group. $L_6$ and $L_7$ are preferably hydrogen atoms.

Examples of the nucleus formed by Z, include thiazole nuclei (for example, thiazole nuclei, such as thiazole, 4-methylthiazole, 4-phenylthiazole, 4,5-dimethylthiazole, 4,5-diphenylthiazole; and benzothiazole nuclei, such as benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-mehtylbenzothiazole, 5,6-dimethylbenzothiazole, 5,6-dimethoxybenzothiazole, 5-hydroxy-6-methylbenzothiazole, tetrahydrobenzothiazole, 4-phenylbenzothiazole), naphthothiazole nuclei (for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), thiazoline nuclei (for example, thiazoline, 4-methylthiazoline, 4-nitrothiazoline), oxazole nuclei (for example, oxazole nuclei such as oxazole, 4-methyloxazole, 4-nitrooxazole, 5-methyloxazole, 4-phenyloxazole, 4,5-diphenyloxazole, 4-ethyloxazole; benzoxazole nuclei such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzothiazole, 5-ethoxybenzoxazole; and naphthoxazole nuclei such as naphtho[2,1-d]oxazole, naphtho[1,2-d]oxazole, naphtho[2,3-d]oxazole, 5-nitronaphtho[2,1-d]oxazole), oxazoline nuclei (for example, 4,4-dimethyloxazoline), selenazole nuclei (for example, selenazole nuclei such as 4-methylselenazole, 4-nitroselenazole, 4-phenylselenazole; benzoselenazole nuclei such as benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole; and naphthoselenazole nuclei such as naphtho[2,1-d]selenazole, naphtho[1,2-d]selenazole), selenazoline nuclei (for example, selenazoline, 4-methylselenazoline), tellurazole nuclei (for example, tellurazole nuclei such as tellurazole, 4-methyltellurazole, 4-phenyltellurazole; benzotellurazole nuclei such as benzotellurazole, 5-chlorobenzotellurazole, 5-methylbenzotellurazole, 5,6-dimethylbenzotellurazole, 6-methoxybenzotellurazole; naphthotellurazole nuclei such as naphtho[2,1-d]tellurazole, naphtho[1,2-d]tellurazole; tellurazoline nuclei such as tellurazoline, 4-methyltellurazoline; and 3,3-dialkylindolenine nuclei such as 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine), imidazole nuclei (for example, imidazole nuclei such as 1-alkylimidazole, 1-alkyl-4-phenylimidazole, 1-arylimidazole; benzimidazole nuclei such as 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidaozle, 1-alkyl-5-fluorobenzimidazole, 1-alkyl-5-trifluoromethylbenzimidazole, 1-alkyl-6-chloro-5-cyanobenzimidazole, 1-alkyl-6-chloro-6-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidaozle, 1-aryl-5-methoxybenzimidazole, 1-aryl-5-cyanobenzimidazole; and naphthoimidazole nuclei such as 1-alkylnaphtho[1,2-d]imidazole, 1-arylnaphtho[1,2-d]imidazole; in which the alkyl moiety is preferably one having from 1 to 8 carbon atoms, for example, an unsubstituted alkyl group such as methyl, ethyl, propyl, isopropyl or butyl group, or a hydroxyalkyl group such as 2-hydroxyethyl or 3-hydroxypropyl group, especially preferably the alkyl moiety is a methyl or ethyl group, and the aryl group is preferably an unsubstituted phenyl group, a halogen (preferably chlorine)-substituted phenyl group, an alkyl (preferably methyl)-substituted phenyl group or an alkoxy (preferably methoxy)-substituted phenyl group), pyridine nuclei (for example, 2-pyridine, 4-pyridine, 5-methyl-2-pyridine, 3-methyl-4-pyridine), quinoline nuclei (for example, quinoline nuclei such as 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-mehtyl-4-quinoline, 8-methoxy-4-quinoline, 6-methyl-4-quinoline, 6-methoxy-4-quinoline, 6-chloro-4-quinoline; isoquinoline nuclei such as 6-nitro-1-isoquinoline, 3,4-dihydro-1-isoquinoline, 6-nitro-3-isoquinoline; and imidazo[4,5-b]quinoxaline nuclei such as 1,3-diehtylimidazo[4,5-b]quinoxaline, 6-chloro-1,3-diallylimidazo[4,5-b]quinoxaline), oxadiazole nuclei, thiadiazole nuclei, tetrazole nuclei and pyrimidine nuclei.

Preferably, the nuclei formed by Z are benzothiazole nuclei, naphthothiazole nuclei, benzoselenazole nuclei and naphthoselenazole nuclei.

The term $X_n$ in formula (I) indicates the presence or absence of cation(s) or anion(s) therein, if necessary for neutralizing the ionic charge of the dye. Therefore, n may be a suitable value of more than 0. Whether the dye of formula (I) is cationic or anionic, or whether it has a net ionic charge, depends upon the auxochrome(s) and substituent(s) on the dye. The counter ion(s) represented by $X_n$ may easily be exchanged after formation of the dye. Typical cations for $X_n$ are inorganic or organic ammonium ions (e.g., triethylamine, pyridine, morpholine), alkali metal ions (e.g., Na, K) and a hydrogen ion; and the anions may be either inorganic anions or organic anions, such as halide anions (e.g., fluoride ion, chloride ion, bromide ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfate ions (e.g., methylsulfate ion), sulfate ions, thiocyanate ions, perchlorate ions, tetrafluoroborate ions, picrate ions, acetate ions, or trifluoromethanesulfonate ions. Preferred is an iodide ion.
Examples of the dyes of formula (I) for use in the present invention are shown below, which, however, are not to be considered limiting.
(I-1)
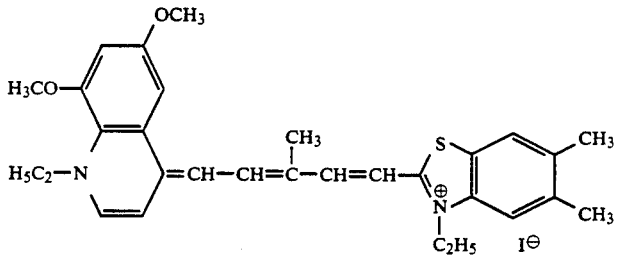
(Y = −0.54)
(I-2)
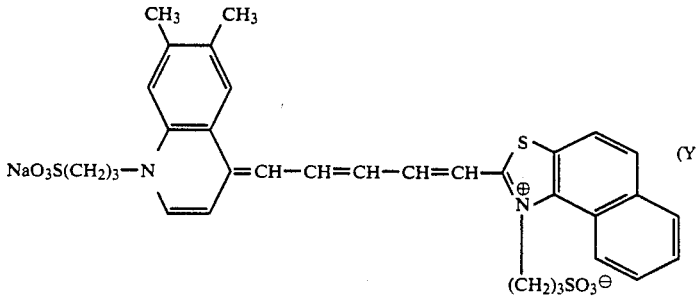
(Y = −0.34)
(I-3)
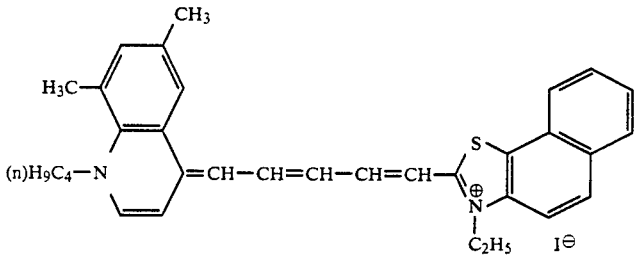
(Y = −0.34)
(I-4)
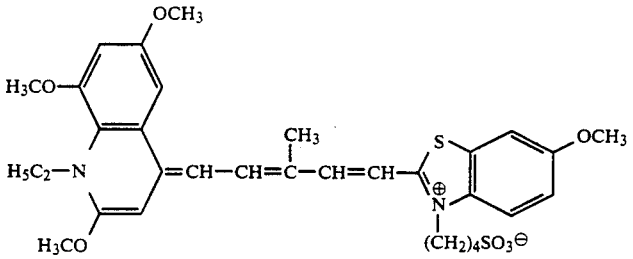
(Y = −0.54)
(I-5)
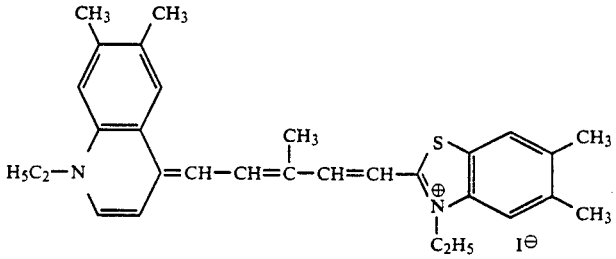
(Y = −0.34)

-continued
(I-6)
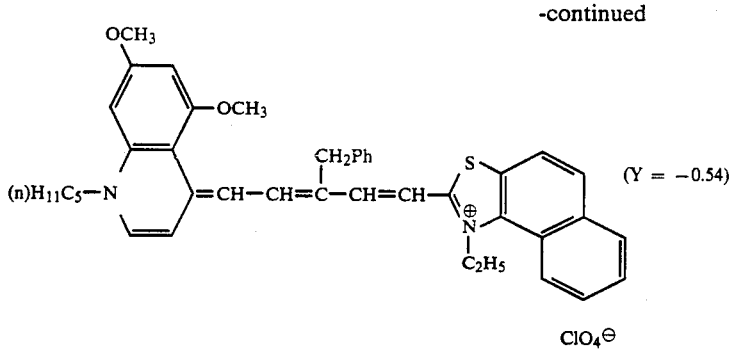
(Y = −0.54)
(I-7)
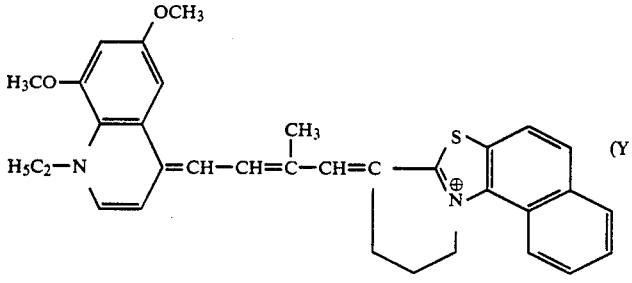
(Y = −0.54)
(I-8)
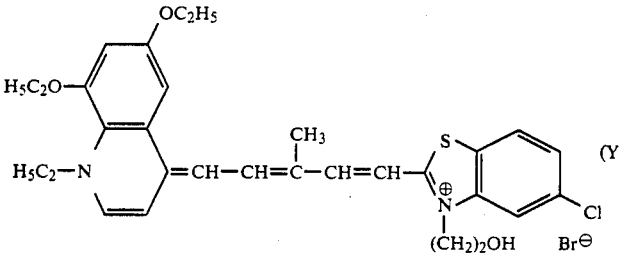
(Y = −0.48)
(I-9)
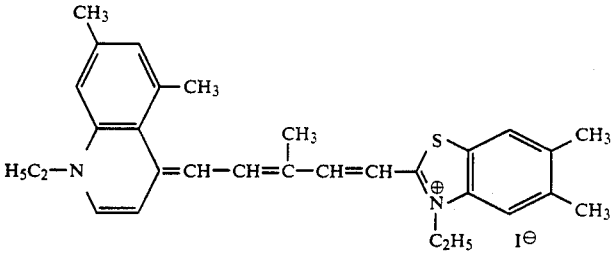
(Y = −0.34)
(I-10)
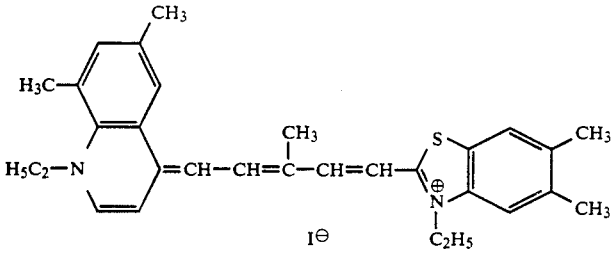
(Y = −0.34)
(I-11)
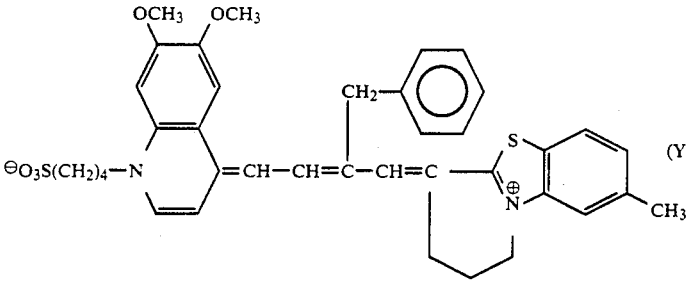
(Y = −0.54)

-continued
(I-12)
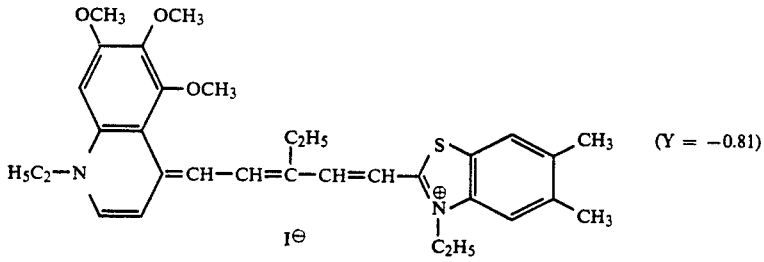
(Y = −0.81)
(I-13)
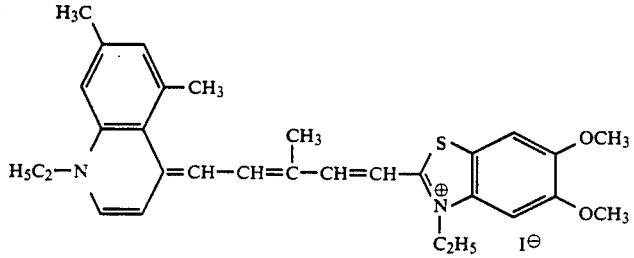
(Y = −0.34)
(I-14)
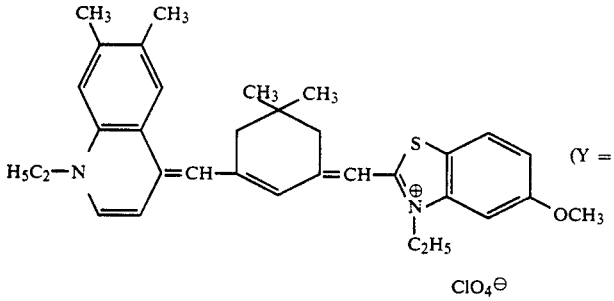
(Y = −0.34)
(I-15)
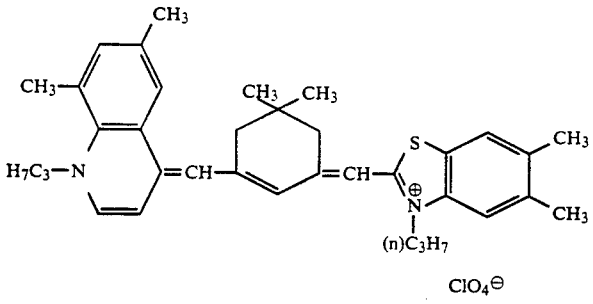
(Y = −0.34)
(I-16)
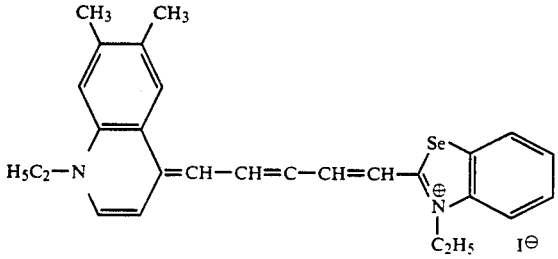
(Y = −0.34)

-continued
(I-17)
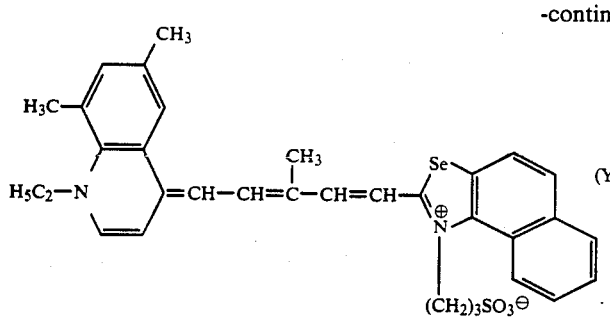
(Y = −0.34)
(I-18)
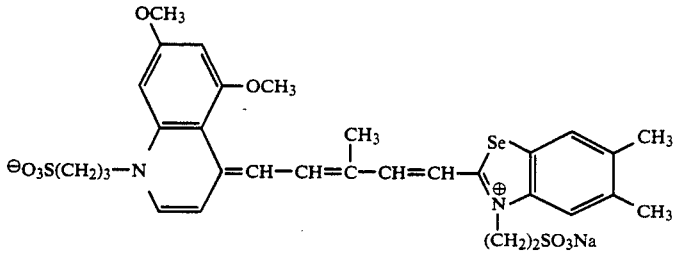
(Y = −0.54)
(I-19)
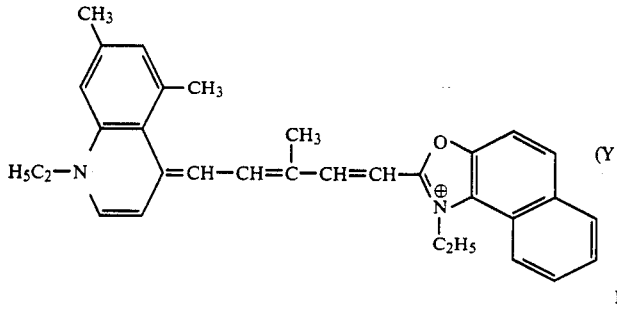
(Y = −0.34)
(I-20)
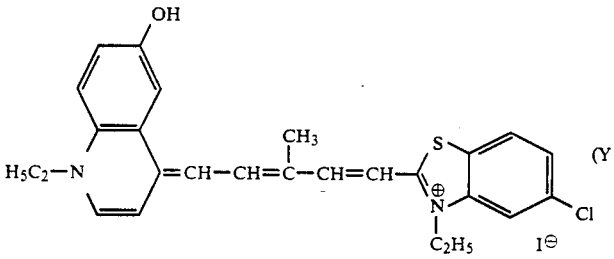
(Y = −0.37)
(I-21)
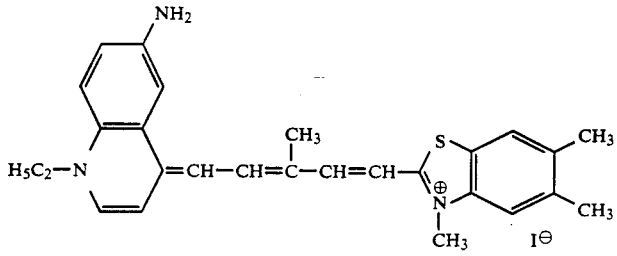
(Y = −0.66)
(I-22)
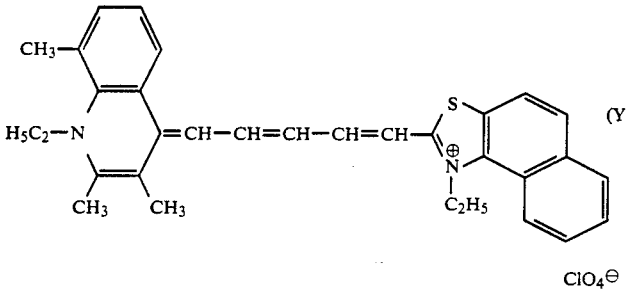
(Y = −0.51)

-continued
(I-23)
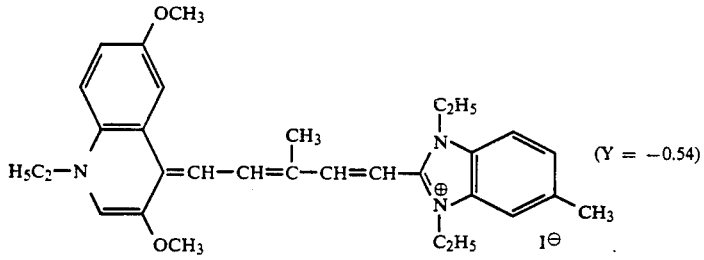
(Y = −0.54)
(I-24)
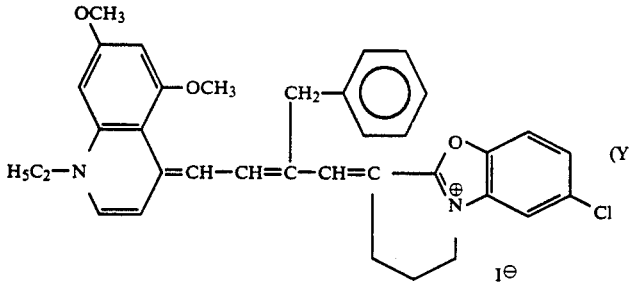
(Y = −0.54)
(I-25)
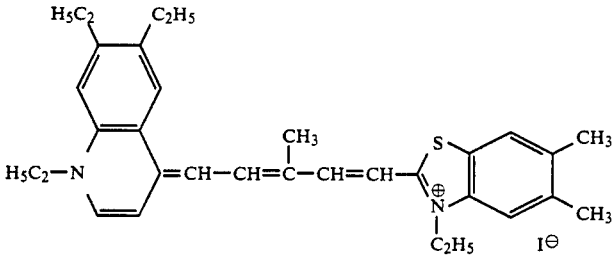
(Y = −0.30)
(I-26)
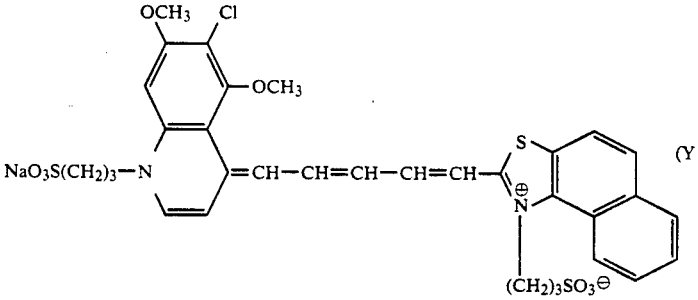
(Y = −0.31)
(I-27)
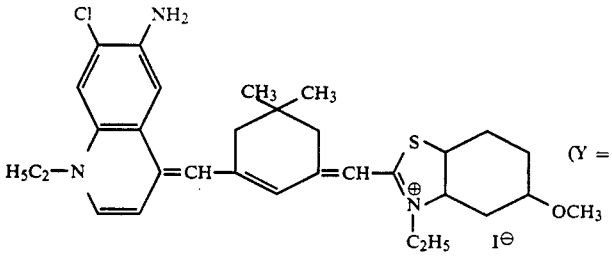
(Y = −0.43)
(I-28)
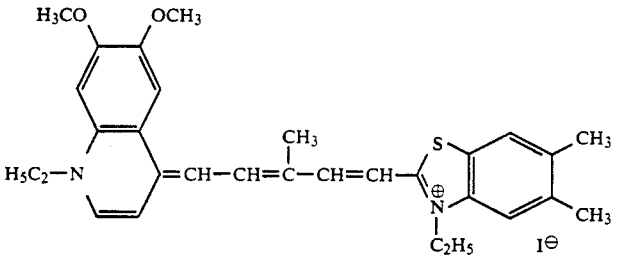
(Y = −0.54)

-continued (I-29)

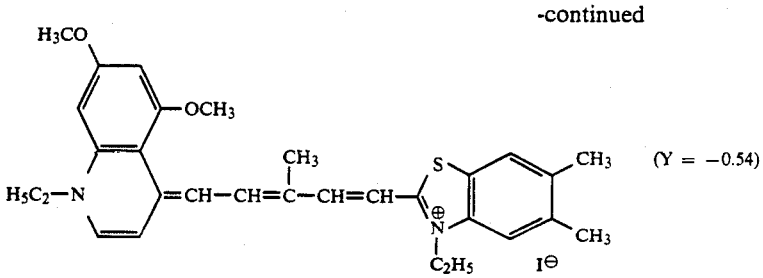

(Y = −0.54)

Among these, Dyes (I-1), (I-5), (I-10), (I-12), (I-13), (I-14), (I-16), (I-19), (I-25), (I-28) and (I-29) are preferred.

General methods for producing the infrared-sensitizing dyes represented by formula (I) for use in the present invention are described, for example, in JP-A 59-192242. Examples of production of the dyes of formula (I) for use in the present invention will be shown below.

SYNTHETIC EXAMPLE 1

Production of Dye (I-1)

A starting material of 4-methyl-5,7-dimethoxyquinoline was produced in accordance with the method described in *Tetrahedron,* Vol. 39, page 2831 (1983).

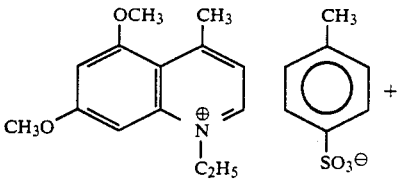

(D-1)

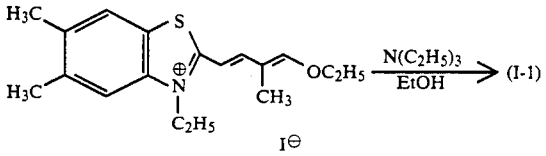

(D-2)

Two g of Compound (D-1) and 2.0 g of Compound (D-2) were added to 20 ml of ethanol and heated on a steam bath. Two ml of triethylamine was dropwise added thereto and reacted for 4 minutes. After being cooled to 0° C., the crystals which precipitated out were taken out by filtration. The crystals thus-obtained were completely dissolved in a mixed solvent of methanol/chloroform, and then the solvent was removed by distillation under reduced pressure. Whereupon, the crystals as precipitated out were taken out by filtration. The operation was repeated two times, and 0.8 g of the intended Dye (I-1) was obtained.

Yield: 27%

$\lambda max = 720$ nm (methanol)

$\epsilon = 1.39 \times 10^5$ m.p.: 152° to 155° C. (decomposition)

SYNTHETIC EXAMPLE 2

Production of Dye (I-9)

(D-2) +

-continued

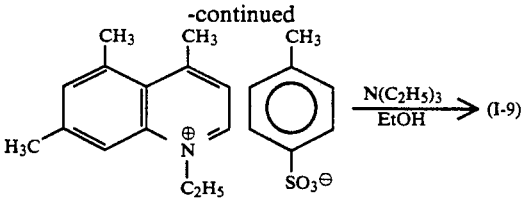

(D-3)

From 1.7 g of Compound (D-2) and 1.5 g of Compound (D-3), 0.7 g of Dye (I-9) was obtained in the same manner as in Synthetic Example 1.

Yield: 30%

$\lambda max = 740$ nm (methanol)

$\epsilon = 1.36 \times 10^5$ m.p.: 170° C.

SYNTHETIC EXAMPLE 3

Production of Dye (I-10)

(D-2) +

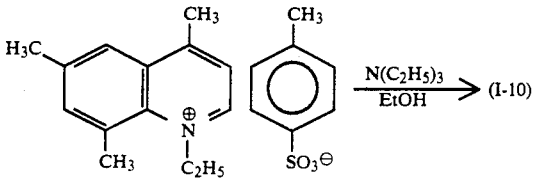

(D-4)

From 1.5 g of Compound (D-2) and 1.4 g of Compound (D-4), 1.0 g of Dye (I-10) was obtained in the same manner as in Synthetic Example 1.

Yield: 49%

$\lambda max = 738$ nm $\epsilon = 1.38 \times 10^5$ m.p.: 245° to 247° C. (decomposition)

SYNTHETIC EXAMPLE 4

Production of Dye (I-12)

(D-2) +

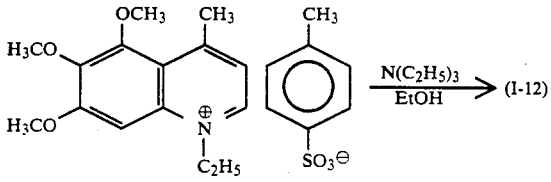

(D-5)

From 0.8 g of Compound (D-2) and 0.82 g of Compound (D-5), 0.15 g of Dye (I-12) was obtained in the same manner as in Synthetic Example 1.

Yield: 13%

λmax = 733 nm $\epsilon = 1.36 \times 10^5$ m.p.: 179° C.

SYNTHETIC EXAMPLE 5

Production of Dye (I-13)

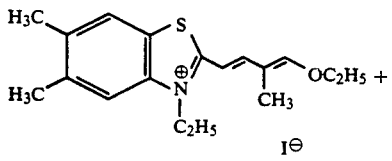

(D-6)

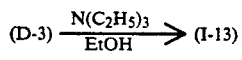

From 1.86 g of Compound (D-6) and 1.5 g of Compound (D-3), 0.7 g of Dye (I-13) was obtained in the same manner as in Synthetic Example 1.

Yield: 29%

λmax = 756 nm $\epsilon = 1.66 \times 10^5$ m.p.: 205° to 207° C.

The above-mentioned infrared-sensitizing dye can be incorporated into a silver halide photographic emulsion constituting the photographic material of the present invention, in an amount of from $5 \times 10^{-7}$ mol to $5 \times 10^{-3}$ mol, preferably from $1 \times 10^{-6}$ mol to $1 \times 10^{-3}$ mol, especially preferably from $2 \times 10^{-6}$ mol to $5 \times 10^{-4}$ mol, per mol of silver halide in the emulsion.

The above-mentioned infrared-sensitizing dye can be dispersed directly in the emulsion. Alternatively, it may be dissolved first in a suitable solvent such as methyl alcohol, ethyl alcohol, methyl cellosolve, acetone, water, pyridine or a mixture thereof, and the resulting solution may be added to the emulsion. For dissolving the dye, ultrasonic waves may be used, if desired.

Other means for adding the above-mentioned infrared-sensitizing dyes of the present invention to emulsions include the method described in U.S. Pat. No. 3,469,987 wherein a dye is dissolved in a volatile organic solvent, the resulting solution is dispersed in a hydrophilic colloid, and the dispersion is added to an emulsion; the method described in JP-B-46-24185 (the term "JP-B" as used herein means an "examined Japanese patent publication") wherein a water-insoluble dye is directly dispersed in a water-soluble solvent, without being dissolved in any solvent, and the resulting dispersion is added to an emulsion; the method described in U.S. Pat. No. 3,822,135 wherein a dye is dissolved in a surfactant and the resulting solution is added to an emulsion; the method described in JP-A-51-74624 wherein a dye is dissolved in a red-shifting compound and the resulting solution is added to an emulsion; and the method described in JP-A-50-80826 wherein a dye is dissolved in an acid containing substantially no water and the resulting solution is added to an emulsion. Moreover, the methods described in U.S. Pat. Nos. 2,912,343, 3,342,605, 2,996,287 and 3,429,835 may also be used for adding the infrared-sensitizing dyes of formula (I) to emulsions.

In the present invention, the time for adding the above-mentioned infrared-sensitizing dye of formula (I) to the silver halide emulsion may be any time before the end of the chemical sensitization of the emulsion.

In the present invention, the compounds represented by formula (II) are preferably used for the purpose of elevating the supersensitizing effect of the photographic materials and/or elevating their storage stability:

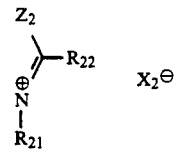

(II)

In formula (II), $Z_2$ represents a non-metallic atomic group necessary for forming a 5-membered or 6-membered nitrogen-containing hetero ring, for example, thiazoliums (e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium), oxazoliums (e.g., oxazolium, 4-methyloxazolium, benzoxazolium, 5-chlorobenzoxazolium, 5-phenylbenzoxazolium, 5-methylbenzoxazolium, naphtho[1,2-d]oxazolium), imidazoliums (e.g., 1-methylbenzimidazolium, 1-propyl-5-chlorobenzimidazolium, 1-ethyl-5,6-dichlorobenzimidazolium, 1-allyl-5-trichloromethyl-6-chlorobenzimidazolium), and selenazoliums (e.g., benzoselenazolium, 5-chlorobenzoselenazolium, 5-methylbenzoselenazolium, 5-methoxybenzoselenazolium, naphtho[1,2-d]selenazolium). $R_{21}$ represents a hydrogen atom, an alkyl group (having 8 or less carbon atoms, such as methyl, ethyl, propyl, butyl or pentyl), or an alkenyl group (e.g., allyl). $R_{21}$ is preferably an alkyl group or an alkenyl group. $R_{22}$ represents a hydrogen atom or a lower alkyl group having preferably 1 to 4 carbon atoms (e.g., methyl, ethyl). The alkyl group for $R_{21}$ and the lower alkyl group for $R_{22}$ may optionally be substituted by one or more substituents selected from, for example, a carboxyl group, a sulfo group, a cyano group, a halogen atom (e.g., fluorine, chlorine, bromine), a hydroxyl group, an alkoxycarbonyl group (having 8 or less carbon atoms, such as methoxycarbonyl, ethoxycarbonyl, benzyloxycarbonyl), an alkoxy group (having 7 or less carbon atoms, such as methoxy, ethoxy, propoxy, butoxy, benzyloxy), an aryloxy group (e.g., phenoxy, p-tolyloxy), an acyloxy group (having 3 or less carbon atoms, such as acetyloxy, propionyloxy), an acyl group (having 8 or less carbon atoms, such as acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl), and an aryl group (e.g., phenyl, p-hydroxyphenyl, p-carboxyphenyl, p-sulfophenyl, α-naphthyl). The alkyl moiety of the substituted alkyl group has 3 or less carbon atoms. The substituted alkyl group may have two or more of these substituents.

$X_2$ represents an acid anion (e.g., $Cl^-$, $Br^-$, $I^-$, $ClO_4^-$, p-toluenesulfonate). $Z_2$ is preferably an atomic group forming thiazoliums, more preferably, one of forming substituted or unsubstituted benzothiazoliums of naphthothiazoliums.

Examples of the compounds of formula (II) for use in the present invention are shown below, but these examples are not limiting.

(II-1)
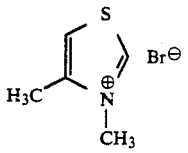
(II-2)
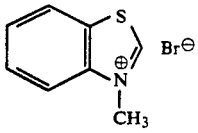
(II-3)
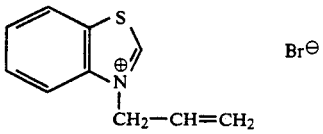
(II-4)
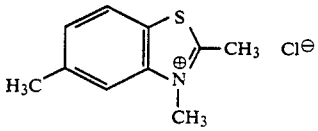
(II-5)
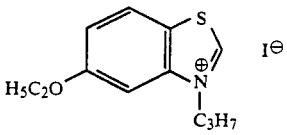
(II-6)
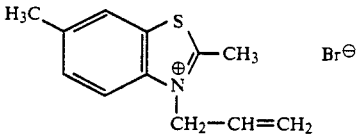
(II-7)
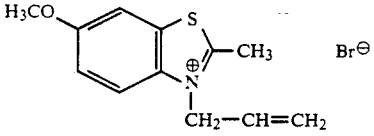
(II-8)
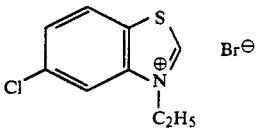
(II-9)
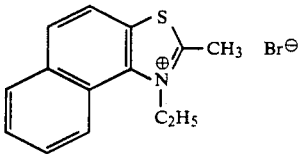
(II-10)
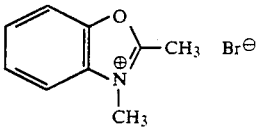
-continued
(II-11)
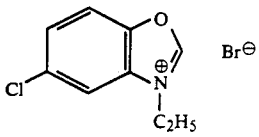
(II-12)
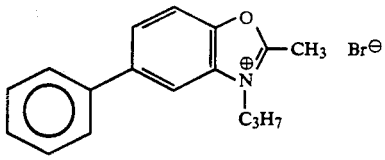
(II-13)
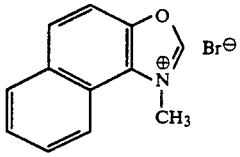
(II-14)
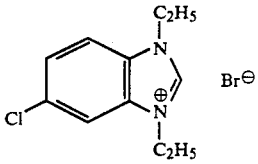
(II-15)
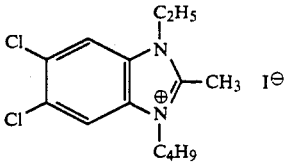
(II-16)
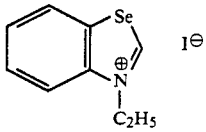
(II-17)
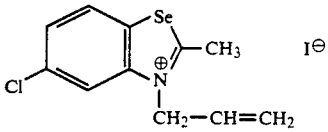
(II-18)
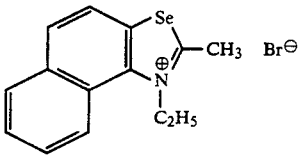
(II-19)
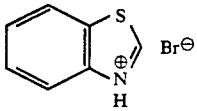
Among these, Compounds (II-2), (II-3), (II-4), (II-6), (II-7), (II-9), (II-16) and (II-17) are preferred.
The compounds represented by formula (II) are advantageously used in an amount of generally about from 0.005 g to 5 g, preferably from 0.01 g to 2 g and more preferably from 0.015 g to 1.2 g, per mol of silver halide in the emulsion to which they are added.

The ratio (by weight) of the infrared-sensitizing dye of formula (I) to the compound of formula (II) in the photographic material of the present invention is advantageously from 1/1 to 1/300, especially advantageously from ½ to 1/50.

The compounds represented by formula (II) may be directly dispersed in emulsions. Also they may be dissolved first in a suitable solvent (e.g., water, methyl alcohol, ethyl alcohol, propanol, methyl cellosolve, acetone) or a mixture thereof and then added to the emulsions. In addition, they may also be added to the emulsions in the form of a solution or colloidal dispersion in accordance with the above-mentioned methods for adding sensitizing dyes.

The compounds represented by formula (II) may be added to emulsions before or after the addition of infrared-sensitizing dyes of formula (I) thereto. If desired, a compound of formula (II) and an infrared-sensitizing dye of formula (I) may be separately dissolved in separate solvents, and the resulting solutions may be added to the emulsion simultaneously or the resulting solutions may be added to the emulsion after having been mixed.

The time for adding the compounds of formula (II) to the silver halide emulsions may be any time before the coating of the emulsions.

In the present invention, compounds represented by formula (III) may be used for further elevating the supersensitizing effect of the photographic materials and/or elevating their storage stability:

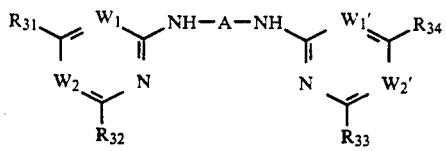

(III)

In formula (III), —A— represents a divalent aromatic residual group, and it may contain a $—SO_3M$ group (wherein M is a hydrogen atom or a water solubility-imparting cation, such as a sodium or potassium ion).

—A— is advantageously selected, for example, from the following $—A_1—$ and $—A_2—$ groups; provided that when all of $R_{31}$, $R_{32}$, $R_{33}$ and $R_{34}$ in the formula do not contain $—SO_3M$, —A— is selected from the group of $—A_1—$.

$—A_1—$:

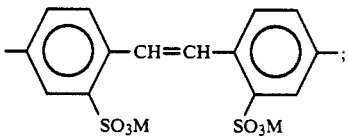

($A_1$-1)

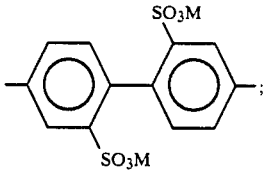

($A_1$-2)

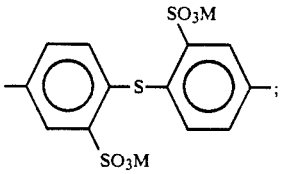

($A_1$-3)

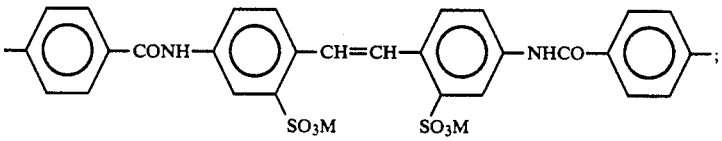

($A_1$-4)

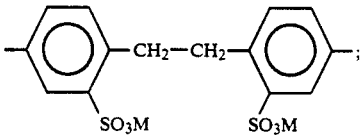

($A_1$-5)

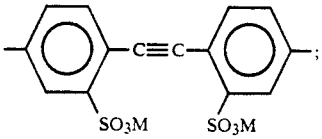

($A_1$-6)

-continued (A1-7)

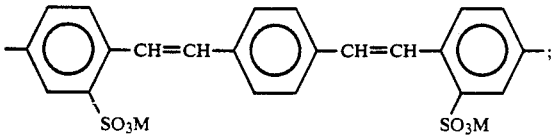

(A1-8)

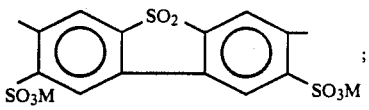

(A1-9)

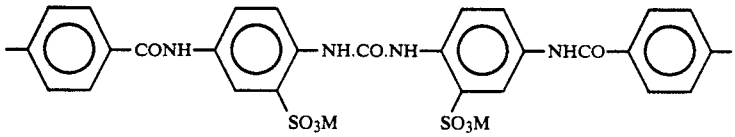

$-A_2-$:

(A2-1)

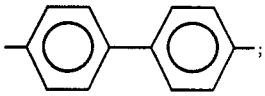

(A2-2)

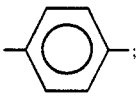

(A2-3)

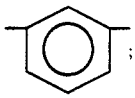

(A2-4)

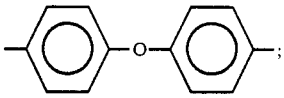

(A2-5)

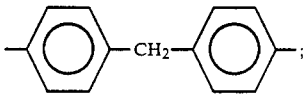

(A2-6)

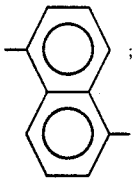

(A2-7)

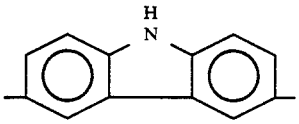

In these formulae, M represents a hydrogen atom or a water solubility-imparting cation.

$R_{31}$, $R_{32}$, $R_{33}$ and $R_{34}$ each represents a hydrogen atom, a hydroxyl group, a lower alkyl group (preferably having from 1 to 8 carbon atoms, such as methyl, ethyl, n-propyl, n-butyl), an alkoxy group (preferably having from 1 to 8 carbon atoms, such as methoxy, ethoxy, propoxy, butoxy), an aryloxy group (e.g., phenoxy, naphthoxy, o-tolyloxy, p-sulfophenoxy), a halogen atom (e.g., chlorine, bromine), a heterocyclic group (e.g., morpholinyl, piperidyl), an alkylthio group (e.g., methylthio, ethylthio), a heterocyclic-thio group (e.g., benzothiazolylthio, benzimidazolylthio, phenyltetrazolylthio), an arylthio group (e.g., phenylthio, tolylthio), an amino group, an unsubstituted alkylamino or substituted alkylamino group (e.g., methylamino, ethylamino, propylamino, dimethylamino, diethylamino, dodecylamino, cyclohexylamino, β-hydroxyethylamino, di-(α-hydroxyethyl)amino, β-sulfoethylamino), an arylamino or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclic amino group (e.g., 2-benzothiazolylamino, 2-pyrazylamino), a substituted or unsubstituted aralkylamino group (e.g., benzylamino, o-anisylamino, m-anisylamino, p-anisylamino), an aryl group (e.g., phenyl), or a mercapto group. $R_{31}$, $R_{32}$, $R_{33}$ and $R_{34}$ may be the same or different from one another. Where —A— is selected from the group of $—A_2—$, at least one of $R_{31}$, $R_{32}$, $R_{33}$ and $R_{34}$ must necessarily have one or more sulfo groups (of either free acids or salts).

$W_1$, $W_2$, $W_1'$ and $W_2'$ each represents —CH= or —N=; provided that at least one of $W_1$ and W2 is —N= and at least one of $W_1'$ and $W_2'$ is —N=.

Examples of compounds represented by formula (III) for use in the present invention are mentioned below, but are not limiting.

(III-1) Disodium 4,4'-bis[2,6-di(benzothiazolyl-2-thio)pyrimidin-4-ylamino]stilbene-2,2'-disulfonate;

(III-2) Disodium 4,4'-bis[2,6-di(benzothiazolyl-2-amino)pyrimidin-4-ylamino)]stilbene-2,2'-disulfonate;

(III-3) Disodium 4,4'-bis[2,6-di(naphthyl-2-oxy)-pyrimidin-4-ylamino]stilbene-2,2'-disulfonate;

(III-4) Disodium 4,4'-bis[2,6-di(naphthyl-2-oxy)-pyrimidin-4-ylamino]bibenzyl-2,2'-disulfonate;

(III-5) Disodium 4,4'-bis(2,6-dianilinopyrimidin-4-ylamino)stilbene-2,2'-disulfonate;

(III-6) Disodium 4,4'-bis[2-chloro-6-(2-naphthyloxy)-pyrimidin-4-ylamino]biphenyl-2,2'-disulfonate;

(III-7) Disodium 4,4'-bis[2,6-di(1-phenyltetrazolyl-5-thio)pyrimidin-4-ylamino]stilbene-2,2'-disulfonate;

(III-8) Disodium 4,4'-bis[2,6-di(benzimidazolyl-2-thio)pyrimidin-4-ylamino]stilbene-2,2'-disulfonate;

(III-9) Disodium 4,4'-bis(2,6-diphenoxypyrimidin-4-ylamino)stilbene-2,2'-disulfonate;

(III-10) Disodium 4,4'-bis(2,6-diphenylthiopyrimidin-4-ylamino)stilbene-2,2'-disulfonate;

(III-11) Disodium 4,4'-bis(2,6-dimercaptopyrimidin-4-ylamino)biphenyl-2,2'-disulfonate;

(III-12) Disodium 4,4'-bis(4,6-dianilino-triazin-2-ylamino)stilbene-2,2'-disulfonate;

(III-13) Disodium 4,4'-bis(4-anilino-6-hydroxy-triazin-2-ylamino)stilbene-2,2'-disulfonate;

(III-14) Disodium 4,4'-bis[4-naphthylamino-6-anilino-triazin-2-ylamino)stilbene-2,2'-disulfonate;

(III-15) Disodium 4,4'-bis[4,6-di(naphthyl-2-oxy)-pyrimidin-4-ylamino]stilbene-2,2'-disulfonate.

Of these examples, (III-1) to (III-12) are preferred, and (III-1), (III-2), (III-3), (III-4), (III-5) and (III-7) are especially preferred.

The compounds of formula (III) are advantageously used in an amount of generally about from 0.01 g to 5 g and preferably from 0.05 g to 2 g, per mol of silver halide in the emulsion to which they are added.

The ratio (by weight) of the infrared-sensitizing dye of formula (I) to the compound of formula (III) in the photographic material of the present invention is advantageously from 1/1 to 1/100, especially advantageously from ½ to 1/50.

The compounds of formula (III) may be directly dispersed in the emulsions. Or also they may be dissolved first in a suitable solvent (e.g., methyl alcohol, ethyl alcohol, methyl cellosolve, water) or a mixture thereof and then added to the emulsions. They may also be added to the emulsions in the form of a solution or colloidal dispersion in accordance with the above-mentioned methods for adding sensitizing dyes. Further, they may be dispersed and added to the emulsions in accordance with the method described in JP-A-50-80119.

The silver halides for use in the present invention may be silver chloride, silver bromide, silver iodide, silver chlorobromide, silver chloroiodide, silver iodobromide or silver chloroiodobromide.

To react soluble silver salts and soluble halides for producing silver halides for use in the present invention, a single jet method, a double jet method or combination of them may be employed.

A so-called reversed mixing method of forming silver halide grains in the presence of excess silver ions may also be employed. One suitable system of a double jet method is a so-called controlled double jet method where the pAg value in the liquid phase for forming silver halide grains is kept constant. In accordance with the method, an emulsion of silver halide grains each having a regular crystalline form and having almost uniform grain sizes can be produced.

To form silver halide grains for use in the present invention, one may use a silver halide solvent for controlling the growth of the grains. Such solvents include, for example, ammonia, potassium rhodanide, ammonium rhodanide, thioether compounds (such as those described in U.S. Pat. Nos. 3,271,157, 3,574,628, 3,704,130, 4,297,439, 4,276,374), thione compounds (such as those described in JP-A-53-144319, JP-A-53-82408, JP-A-55-77737), and amine compounds (such as those described in JP-A 54 100717).

The silver halide grains for use in the present invention preferably have a mean grain size of 1.0 μm or less, especially preferably 0.7 μm or less. The mean grain size is generally used and understood by those skilled in the art of silver halide photography. The grain size indicates the diameter of a grain, where the grain is spherical or nearly spherical. Where the grain is cubic, the grain size is represented by:

$$(\text{length of edge}) \times \frac{\sqrt{4}}{\pi}$$

The mean grain size is obtained as an algebraic or geometric mean value based on the projected area of all grains. For the details of the method of obtaining the mean grain size, one should see the disclosure in *The Theory of the Photographic Process* (by C. E. Mees & T. H. James), 3rd Ed., pages 36 to 43 (published by McMillan Co., 1966).

In the present invention, water-soluble rhodium salts, such as rhodium chloride, rhodium trichloride or rhodium ammonium chloride, are preferably used. Complexes of these salts may also be used. Such rhodium salts may be added at any time before the finish of the first ripening in the preparation of the emulsions, and they are desirably added during the formation of the grains. The amount to be added is preferably from $1\times10^{-8}$ mol to $1\times10^{-6}$ mol and more preferably from $4\times10^{-8}$ to $1\times10^{-6}$ mol, per mol of silver.

In addition, water-soluble iridium salts such as $Na_3IrCl_6$ or $Na_2IrCl_6$ may be used. The time for adding water-soluble iridium salts is desirably before the first ripening in the preparation of the emulsions; and especially preferably they are added during the formation of the grains. The amount to be added is preferably from $1\times10^{-8}$ mol to $1\times10^{-5}$ mol and more preferably from $4\times10^{-8}$ mol to $1\times10^{-6}$ mol, per mol of silver.

Various gold salts may be used as a gold sensitizer for sensitizing emulsions of the present invention. For instance, they include potassium chloroaurate, potassium auric thiocyanate, potassium chloroaurate and auric trichloride. Examples of suitable gold sensitizers are described in U.S. Pat. Nos. 2,399,083 and 2,642,361.

The sulfur sensitizers to be used for sensitizing emulsions of the present invention include sulfur compounds in gelatin as well as other various sulfur compounds such as thiosulfates, thioureas, thiazoles and rhodanines. Examples of suitable sulfur sensitizers are described in U.S. Pat. Nos. 1,574,944, 2,278,947, 2,410,689, 2,728,668, 3,501,313 and 3,656,955. Preferred sulfur compounds are thiosulfates and thiourea compounds.

The amount of sulfur sensitizers and gold sensitizers to be added is preferably from $1\times10^{-2}$ to $1\times10^{-7}$ mol, more preferably from $1\times10^{-3}$ mol to $5\times10$hu $-6$ mol, per mol of silver.

The molar ratio of sulfur sensitizer to gold sensitizer to be used may be from $\frac{1}{3}$ to 3/1, preferably from $\frac{1}{2}$ to 2/1.

In the present invention, a reduction sensitizing method may also be employed.

Suitable reducing sensitizers include stannous salts, amines, formamidinesulfinic acids and silane compounds.

The temperature for the chemical sensitization of emulsions of the present invention may be selected from the range of from 30° C. to 90° C. The pH value in the chemical sensitization may be from 4.5 to 8.5, preferably from 5.0 to 7.0. The time for chemical sensitization could be defined as varying in accordance with the temperature in the system, the amount of chemical sensitizer used and the pH value in the system. However, it may be selected from the range of from several minutes to several hours and, generally, it is from 10 minutes to 200 minutes.

Where silver halide emulsions are infrared-spectral sensitized, the stability of the emulsions is often worsened. In order to prevent this, the addition of water-soluble bromides to the emulsions is effective. Suitable water-soluble bromides include various compounds capable of being dissociated into bromide ions in water. For instance, they include bromide salts such as ammonium, potassium, sodium or lithium bromide. In addition, suitable organic bromides such as tetraethyl ammonium bromide and ethylpyridinium bromide may be used. However, of these bromide salts, cadmium bromide and zinc bromide are not desired since they are harmful to human bodies if too much of them is absorbed. Therefore, the above-mentioned harmless water-soluble bromides are preferred.

The amount of water-soluble bromides added to the emulsions may be such that would substantially increase the sensitivity of the emulsion and/or would substantially inhibit time-dependent fluctuation of the sensitivity thereof. The amount of water-soluble bromides added to the emulsions may widely vary, and especially preferred results can be obtained when they are added in an amount of from 0.0003 to 0.01 mol per mol of silver. More preferred results can be attained when they are added in an amount of from 0.0005 to 0.005 mol per mol of silver. Where the anion of the sensitizing dye of formula (I) is bromine or bromide, the above-defined amount of bromides is the sum of bromides and anions of the dye.

The time for adding water-soluble bromides may be any time after the formation of the silver halide grains, and it is preferably after the finish of their chemical sensitization.

Other sensitizing dyes may also be used in combination with the sensitizing dyes of formula (I) of the present invention. For instance, the sensitizing dyes described in U.S. Pat. Nos. 3,703,377, 2,688,545, 3,397,060, 3,615,635, 3,628,964, British Patents 1,242,588, 1,293,862, JP-B-43-4936, JP-B-44-14030, JP-B-43-10773, U.S. Pat. No. 3,416,927, JP-B-43-4930, U.S. Pat. Nos. 3,615,613, 3,615,632, 3,617,295, 3,635,721 can be used.

Various compounds can be added to the photographic emulsions for use in the present invention, for the purpose of preventing a reduction in the sensitivity of the photographic materials during their manufacture, storage or processing or preventing the generation of fog in them. Such compounds include, for example, nitrobenzimidazole, ammonium chloroplatinate, 4-hydroxy-6-methyl-1,3,3a,7-tetrazaindene, 1-phenyl-5-mercaptotetrazole and other heterocyclic compounds, mercury compounds, mercapto compounds and metal salts, which have been known from ancient days. Some examples of suitable compounds are described in K. Mees, *The Theory of the Photographic Process,* (3rd Ed. 1966), pages 344 to 349 and the related references. Other examples include the thiazolium salts described in U.S. Pat. Nos. 2,131,038, 2,694,716; the azaindenes described in U.S. Pat. Nos. 2,886,437, 2,444,605; the urazoles described in U.S. Pat. No. 3,287,135; the sulfocatechols described in U.S. Pat. No. 3,236,652; the oximes described in British Patent 623,448; the mercaptotetrazoles described in U.S. Pat. Nos. 2,403,927, 3,266,897, 3,397,987; nitrons; nitroimidazoles; the polyvalent metal salts described in U.S. Pat. No. 2,839,405; the thiuronium salts described in U.S. Pat. No. 3,220,839; and the salts of palladium, platinum or gold described in U.S. Pat. Nos. 2,566,263, 2,597,915.

Silver halide photographic emulsions for use in the present invention can contain a developing agent such as hydroquinones, catechols, aminophenols, 3-pyrazolidones, ascorbic acid or derivatives thereof, reductones, phenylenediamines, or a combination of several developing agents. Developing agents can be incorporated into silver halide emulsion layers and/or other photographic layers (for example, protective layer, interlayer, filter layer, anti-halation layer, backing layer). Developing agents can be incorporated thereinto as a solution dissolved in a suitable solvent or as a dispersion in accordance with the technology described in U.S. Pat. No. 2,592,368 and French Patent 1,505,778.

A development accelerator, for example, compounds described in U.S. Pat. Nos. 3,288,612, 3,333,959, 3,345,175, 3,708,303, British Patent 1,098,748, German Patents 1,141,531, 1,183,784, can be used.

Photographic emulsions for use in the present invention can contain an inorganic or organic hardening agent. Examples of the hardening agent include chromium salts (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-methylenebis-[$\beta$-(vinylsulfonyl)propionamido]), active halogen compounds (e.g., 2,4-dichloro-6-hydroxy-s-triazine), mucohalogenic acids (e.g., mucochloric acid, mucophenoxychloric acid), isoxazoles, dialdehyde starch, and 2-chloro-6-hydroxytriazinylated gelatin. These can be used singly or in combination of two or more. Specific examples of the compounds are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, 3,543,292, British Patents 676,628, 826,544, 1,270,578, German Patents 872,153, 1,090,427, JP-B-34-7133, JP-B-46-1872.

The photographic emulsion layers and other hydrophilic colloid layers constituting the photographic materials of the present invention may contain various surfactants for various purposes, for instance as a coating aid, to prevent static charges, to improve sliding properties, to improve emulsification or dispersion and to improve photographic characteristics (such as acceleration of developability, elevation of hardness and sensitization).

Examples of suitable surfactants include non-ionic surfactants such as saponins (non-steroid type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglycerides, alkylphenol polyglycerides), fatty acid esters of polyalcohols, alkyl esters of saccharides; anionic surfactants containing an acidic group such as a carboxyl group, a sulfo group, a phospho group, a sulfate group or a phosphate group, such as alkylcarboxylates, alkylsulfonates, alkylbenzenesulfonates, alkylnaphthalenesulfonates, alkylsulfates, alkylphosphates, N-acyl-N-alkyltaurins, sulfosuccinates, sulfoalkylpolyoxyethylene alkylphenyl ethers, polyoxyethylene alkylphosphate; amphoteric surfactants such as amino acids, aminoalkylsulfonic acids, aminoalkylsulfates or aminoalkylphosphates, alkylbetains, amineoxides; and cationic surfactants such as alkylamine salts, aliphatic or aromatic quaternary ammonium salts, heterocyclic quaternary ammonium salts (e.g., pyridinium or imidazolium salts), and aliphatic or heterocyclic phosphonium or sulfonium salts.

For the purpose of improving the sharpness of the toe of the characteristic curve and of obtaining halftone dot images or line images with a high quality, one may use polyalkylene oxide compounds (for example, condensates of polyalkylene oxides comprising at least 10 units of alkylene oxides each having from 2 to 4 carbon atoms, such as ethylene oxide, propylene-1,2-oxide, butylene-1,2-oxide, preferably ethylene oxide, and compounds having at least one active hydrogen atom, such as water, aliphatic alcohols, aromatic alcohols, fatty acids, organic amines or hexitol derivatives; or block copolymers composed of two or more different polyalkylene oxides). Examples of such compounds include the polyalkylene oxide compounds described in JP-A-50-156423, JP-A-52-108130 and JP-A-53-3217. Such polyalkylene oxide compounds can be used singly or in combination of two or more.

As a binder or protective colloid for the photographic emulsions of the present invention, gelatin is advantageously used, but any other hydrophilic colloids may also be used. For instance, one may use proteins such as gelatin derivatives, graft polymers of gelatin and other polymers, albumin, casein; cellulose derivatives such as hydroxyethyl cellulose, carboxymethyl cellulose cellulose sulfates, and saccharide derivatives such as sodium alginate, starch derivatives; as well as other synthetic hydrophilic polymer substances of homopolymers or copolymers, such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole.

The gelatin may be not only a lime-processed gelatin but also an acid-processed gelatin. In addition, hydrolyzates of gelatin or enzyme-decomposed products of gelatin may be used. Suitable gelatin derivatives include those obtained by reacting gelatin and various compounds such as acid halides, acid anhydrides, isocyanates, bromoacetic acid, alkanesultones, vinylsulfonamides, maleimide compounds, polyalkylene oxides or epoxy compounds. Examples are described in U.S. Pat. Nos. 2,614,928, 3,132,945, 3,186,846, 3,312,553, British Patent 861,414, 1,033,189, 1,005,784, and JP-B-42-26845.

The photographic emulsions of the present invention can contain a dispersion of water-insoluble or sparingly water-soluble synthetic polymers, for the purpose of improving the dimensional stability of the photographic materials. For instance, one may use polymers composed of single or mixed monomers of alkyl (meth)acrylates, alkoxyacryl (meth)acrylates, glycidyl (meth)acrylates, (meth)acrylamides, vinyl esters (e.g., vinyl acetate), acrylonitrile, olefins and/or styrene, and optionally other comonomers of acrylic acid, methacrylic acid, $\alpha,\beta$-unsaturated dicarboxylic acids, hydroxyalkyl (meth)acrylates, sulfoalkyl (meth)acrylates and/or styrenesulfonic acid.

Any photographic developing method may be applied to the photographic materials of the present invention. Suitable developing agents to be used in developers for developing the materials include dihydroxybenzene developing agents, 1-phenyl-3-pyrazolidone developing agents and p-aminophenol developing agents. These may be used singly or in combination thereof. For instance, a combination of 1-phenyl-3-pyraozlidones and dihydroxybenzenes or a combination of p-aminophenols and dihydroxybenzenes can be employed. If desired, the photographic materials of the present invention may also be processed with an infectious developer containing a sulfite ion buffer (e.g., carbonyl bisulfite) and hydroquinone.

Suitable dihydroxybenzene developing agents include hydroquinone, chlorohydroquinone, bromohydroquinone, isopropylhydroquinone, toluhydrohydroquinone, methylhydroquinone, 2,3-dichlorohydroquinone, 2,5-dimethylhydroquinone; suitable 1-phenyl-3-pyrazolidone developing agents include 1-phenyl-3-pyrazolidone, 4,4-dimethyl-1-phenyl-3-pyrazolidone, 4-hydroxymethyl-4-methyl-1-phenyl-3-pyraozlidone, 4,4-dihydroxymethyl-1-phenyl-3-pyrazolidonene; and suitable p-aminophenol developing agents include p-aminophenol and N-methyl-p-aminophenol.

The developer for use in the invention can contain, as a preservative, compounds of giving free sulfite ions, such as sodium sulfite, potassium sulfite, potassium metabisulfite or sodium bisulfite. If an infectious developer is used, it may contain formaldehydesodium bisulfite which gives almost no free sulfite ion.

The alkali agents in the developer for use in the present invention include, for example, potassium hydroxide, sodium hydroxide, potassium carbonate, sodium carbonate, sodium acetate, potassium tertiary phosphate, diethanolamine and triethanolamine. The developer generally has a pH value of 9 or more, preferably 9.7 or more.

The developer may contain organic compounds known as antifoggants or development inhibitors. Examples of such compounds include azoles such as benzothiazolium salts, nitroindazoles, nitrobenzimidazoles, chlorobenzimidazoles, bromobenzimidazoles, mercaptotetrazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole); mercaptopyrimidines; mercaptotriazines; thioketo compounds such as oxazolinethione; azaindenes such as triazaindenes, tetrazaindenes (especially, 4-hydroxy-substituted (1,3,3a,7)tetrazaindenes), pentaazaindenes; and benzenethiosulfonic acids, benzenesulfinic acids, benzenesulfonic acid amides, and sodium 2-mercaptobenzimidazole-5-sulfonate.

The developer for use in the present invention can contain the above-mentioned polyalkylene oxides as a development inhibitor. For instance, polyethylene oxides having a molecular weight of from 1000 to 10000 can be incorporated therein in an amount of from 0.1 to 10 g/liter.

The developer for use in the present invention preferably contains, as a hard water softener, nitrilotriacetic acid, ethylenediaminetetraacetic acid, triethylenetetraminehexaacetic acid or diethylenetetraminepentaacetic acid.

Any conventional fixer for processing the photographic materials of the present invention can be used. Suitable fixing agents include thiosulfates and thiocyanates as well as other organic sulfur compounds known to have an effect as a fixing agent.

The fixer for use in the present invention can contain, as a hardening agent, a water-soluble aluminium salt.

The processing temperature and time for processing the photographic material of the present invention may be defined. In general, the processing temperature is suitably from 18° C. to 50° C. Rapid processing with an automatic developing machine is recommended to have a processing time of from 15 to 200 seconds.

Also the silver halide photographic material of the present invention is preferably processed at a period of 60 seconds or less from the start of development to the finish of drying and/or preferably processed at a linear speed of 1500 mm/min or more, with the automatic developing machine, etc.

The present invention will be explained in more detail by way of the following examples, which, however, are not intended to restrict the scope of the present invention.

EXAMPLE 1

An aqueous solution of 1 kg of $AgNO_3$ and an aqueous solution containing 161 g of KBr and 205 g of NaCl were simultaneously added to an aqueous solution containing 72 g of gelatin and 16 g of NaCl, each at a constant rate over a period of 32 minutes (Br=23 mol %).

During the first half in the addition, rhodium chloride and $K_3IrCl_6$ were added each in an amount of $5\times10^{-7}$ mol/mol of Ag for 10 minutes. Next, soluble salts were removed, and gelatin was added. After the pH value of the system was adjusted to 6.0 and the pAg value thereof to 7.5, chloroauric acid and sodium thiosulfate were added. The resulting emulsion was chemically sensitized at 60° C. The time for the chemical sensitization was at a point of giving the highest sensitivity. To the emulsion were added 4-hydroxy-6-mehtyl-1,3,3a,7-tetrazaindene as a stabilizer and phenoxyethanol as an antiseptic.

One kg of the emulsion was weighed, and 110 ml of a 0.05% solution of a sensitizing dye of formula (I) was added thereto as shown in Table 1 below. Next, 100 mg/m$^2$ of hydroquinone, polyethyl acrylate latex as a plasticizer in an amount of 25% to the gelatin binder, and 85 mg/m$^2$ of 2-bis(vinylsulfonylacetamido)ethane as a hardening agent were added thereto. The resulting emulsion was coated on a polyester support in an amount of 3.7 g/m$^2$ (i.e., the amount converted to silver). The amount of gelatin coated was 2.0 g/m$^2$.

Over the layer was coated a protective layer containing 0.8 g/m$^2$ of gelatin, 40 mg/m$^2$ of polymethyl methacrylate grain having a mean grain size of 2.5 μm as a mat agent, 30 mg/m$^2$ of colloidal silica having a mean grain size of 4 μm, 80 mg/m$^2$ of silicone oil, 80 mg/m$^2$ of sodium dodecylbenzenesulfonate as a coating aid, a surfactant (1) having the following structural formula, 150 mg/m$^2$ of polyethyl acrylate latex, and 6 mg/m$^2$ of 1,1'-disulfobutyl-3,3,3',3'-tetramethyl-5,5'-disulfoindotricarbocyanine potassium salt.

$C_8F_{17}SO_2N(C_3H_7)-CH_2COOK$ Surfactant (1)

Each of the samples thus prepared had a backing layer and a backing protective layer each having the composition mentioned below, on the surface of the support opposite to the emulsion-coated surface.

| | |
|---|---|
| Backing Layer: | |
| Gelatin | 2.4 g/m$^2$ |
| Sodium Dodecylbenzenesulfonate | 60 mg/m$^2$ |
| Dye (2) | 80 mg/m$^2$ |
| Dye (3) | 30 mg/m$^2$ |
| 1,1'-Disulfobutyl-3,3,3',3'-tetramethyl-5,5'-disulfoindotricarbocyanine Potassium Salt | 80 mg/m$^2$ |
| 1,3-Divinylsulfonyl-2-propanol | 60 mg/m$^2$ |
| Potassium Polyvinylbenzenesulfonate | 30 mg/m$^2$ |
| Backing Protective Layer: | |
| Polymethyl Methacrylate (mean grain size 3.5 μm) | 40 mg/m$^2$ |
| Sodium Dodecylbenzenesulfonate | 20 mg/m$^2$ |
| Surfactant (1) | 2 mg/m$^2$ |
| Silicone Oil | 100 mg/m$^2$ |

Surfactant (1)

$C_8F_{17}SO_2N(C_3H_7)-CH_2COOK$

Surfactant (2)

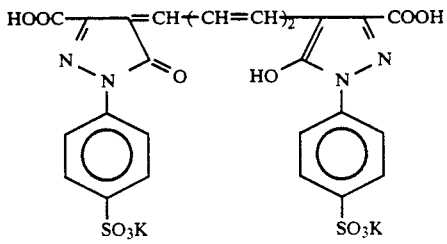

Surfactant (3)

-continued

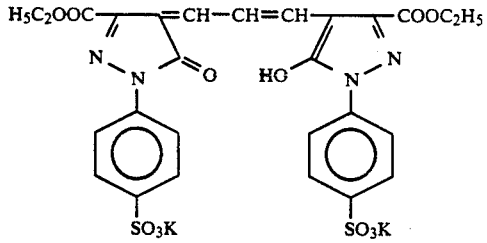

Each of these samples was exposed by a scanning exposure with a semiconductor laser emitting a ray of 780 nm. The exposed samples where then developed, fixed, rinsed and dried with an automatic developing machine ("FG-310 PTS Model", manufactured by Fuji Photo Film Co.), using a developer and a fixer each having the composition mentioned below, at 38° C. for 14 seconds. The processed samples were then subjected to sensitometry.

The sensitivity (reciprocal of the amount of exposure of giving density of 3.0, as relative sensitivity) and fog value of each sample are shown in Table 1 below.

| | |
|---|---|
| Composition of Developer: | |
| Water | 720 ml |
| Disodium Ethylenediaminetetraacetate | 4 g |
| Sodium Hydroxide | 44 g |
| Sodium Sulfite | 45 g |
| 2-Methylimidazole | 2 g |
| Sodium Carbonate | 26.4 g |
| Boric Acid | 1.6 g |
| Potassium Bromide | 1 g |
| Hydroquinone | 36 g |
| Diethylene Glycol | 39 g |
| 5-Methylbenzotriazole | 0.2 g |
| Pyrazole | 0.7 g |
| Water to make | 1 liter |
| Composition of Fixer: | |
| Ammonium Thiosulfate | 170 g |
| Sodium Sulfite (anhydride) | 15 g |
| Boric Acid | 7 g |
| Glacial Acetic Acid | 15 ml |
| Potassium Alum | 20 g |
| Ethylenediaminetetraacetic Acid | 0.1 g |
| Tartaric Acid | 3.5 g |
| Water to make | 1 liter |

TABLE 1

| Sample No. | Sensitizing Dye of Formula (I) and Comparative Sensitizing Dye | Sensitivity | Fog | Remarks |
|---|---|---|---|---|
| 1-1 | a-1 | 100 (standard) | 0.06 | Comparison |
| 1-2 | I-2 | 151 | 0.05 | Invention |
| 1-3 | I-26 | 117 | 0.05 | Invention |
| 1-4 | a-2 | 100 (standard) | 0.05 | Comparison |
| 1-5 | a-3 | 102 | 0.05 | Comparison |
| 1-6 | I-1 | 132 | 0.05 | Invention |
| 1-7 | I-5 | 158 | 0.05 | Invention |
| 1-8 | I-28 | 155 | 0.05 | Invention |
| 1-9 | I-9 | 145 | 0.05 | Invention |
| 1-10 | I-29 | 155 | 0.05 | Invention |
| 1-11 | I-21 | 120 | 0.05 | Invention |
| 1-12 | I-25 | 155 | 0.05 | Invention |
| 1-13 | I-12 | 135 | 0.05 | Invention |
| 1-14 | a-4 | 100 (standard) | 0.06 | Comparison |
| 1-15 | I-14 | 148 | 0.05 | Invention |
| 1-16 | I-27 | 123 | 0.05 | Invention |
| 1-17 | a-5 | 100 (standard) | 0.05 | Comparison |
| 1-18 | I-7 | 135 | 0.05 | Invention |

(a-1)

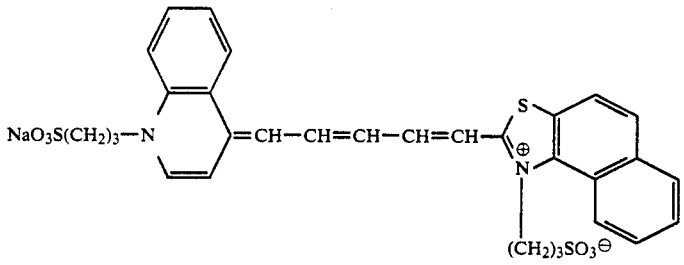

(Y = 0)

(a-2)

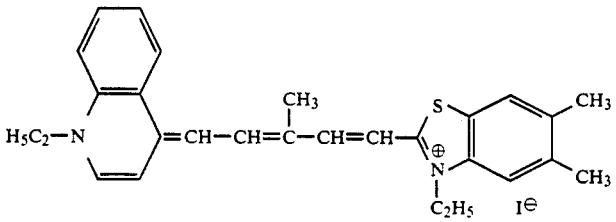

(Y = 0)

TABLE 1-continued

| Sample No. | Sensitizing Dye of Formula (I) and Comparative Sensitizing Dye | Sensitivity | Fog | Remarks |
|---|---|---|---|---|
| (a-3) | 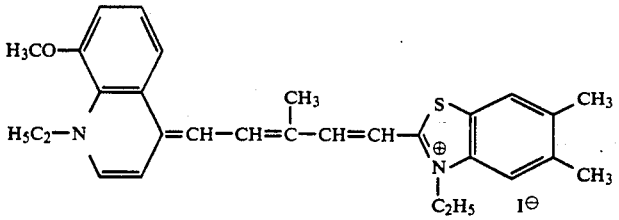 (Y = −0.27) | | | |
| (a-4) | 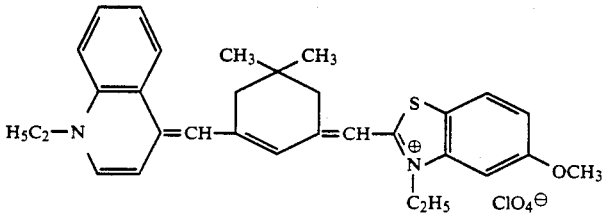 (Y = 0) | | | |
| (a-5) | 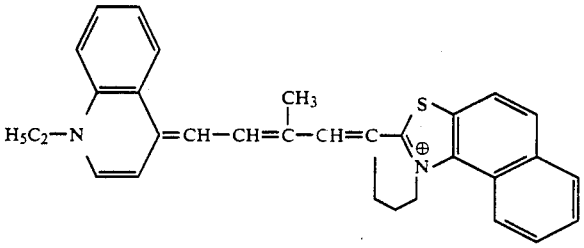 (Y = 0) | | | |

As is apparent from the results in Table 1 above, it is understood that the sensitizing dyes of the present invention all have high sensitizing function.

EXAMPLE 2

One kg of an emulsion prepared as in Example 1 was weighed and a coating emulsion was prepared in the same manner as in Example 1, except that a 0.05% solution of a sensitizing dye of formula (I) as shown in Table 2 below was first added and thereafter 55 ml of a 0.3% methanol solution of a compound of formula (II) also as shown in Table 2 was added. The coating emulsion thus-formed was coated on a polyester support in an amount of 3.7 g/m$^2$ (i.e., the amount converted to silver), the amount of gelatin coated being 2.0 g/m$^2$.

A protective layer, a backing layer and a backing protective layer were prepared and coated in the same manner as in Example 1. The photographic material samples thus-prepared were exposed, processed and subjected to sensitometry also in the same manner as in Example 1.

The results obtained are shown in Table 2.

TABLE 2

| Sample No. | Sensitizing Dye Added | Amount of Sensitizing Dye Added (ml/kg of emulsion) | Compound of formula (I) Added | Sensitivity | Fog |
|---|---|---|---|---|---|
| 2-1 | I-1 | 70 | — | 100 (standard) | 0.05 |
| 2-2 | I-1 | 105 | — | 76 | 0.05 |
| 2-3 | I-1 | 70 | II-7 | 214 | 0.05 |
| 2-4 | I-1 | 105 | II-7 | 245 | 0.05 |
| 2-5 | I-6 | 70 | — | 100 (standard) | 0.05 |
| 2-6 | I-6 | 105 | — | 79 | 0.05 |
| 2-7 | I-6 | 70 | II-7 | 234 | 0.05 |
| 2-8 | I-6 | 105 | II-7 | 295 | 0.05 |
| 2-9 | I-9 | 70 | — | 100 (standard) | 0.05 |
| 2-10 | I-9 | 105 | — | 83 | 0.05 |
| 2-11 | I-9 | 70 | II-7 | 245 | 0.05 |
| 2-12 | I-9 | 105 | II-7 | 309 | 0.05 |
| 2-13 | I-17 | 70 | — | 100 (standard) | 0.05 |
| 2-14 | I-17 | 105 | — | 79 | 0.05 |
| 2-15 | I-17 | 70 | II-7 | 251 | 0.05 |
| 2-16 | I-17 | 105 | II-7 | 316 | 0.04 |
| 2-17 | I-19 | 70 | — | 100 (standard) | 0.05 |
| 2-18 | I-19 | 105 | — | 71 | 0.05 |
| 2-19 | I-19 | 70 | II-7 | 234 | 0.05 |
| 2-20 | I-19 | 105 | II-7 | 288 | 0.05 |
| 2-21 | I-22 | 70 | — | 100 (standard) | 0.05 |
| 2-22 | I-22 | 105 | — | 74 | 0.05 |

TABLE 2-continued

| Sample No. | Sensitizing Dye Added | Amount of Sensitizing Dye Added (ml/kg of emulsion) | Compound of formula (I) Added | Sensitivity | Fog |
|---|---|---|---|---|---|
| 2-23 | I-22 | 70 | II-7 | 240 | 0.05 |
| 2-24 | I-22 | 105 | II-7 | 245 | 0.05 |
| 2-25 | I-25 | 70 | — | 100 (standard) | 0.05 |
| 2-26 | I-25 | 105 | — | 68 | 0.05 |
| 2-27 | I-25 | 70 | II-7 | 234 | 0.05 |
| 2-28 | I-25 | 105 | II-7 | 263 | 0.04 |

As is apparent from the results in Table 2 above, it is understood that the sensitizing function of the sensitizing dyes of the present invention is increased by combination with the compounds of formula (II).

EXAMPLE 3

One kg of the emulsion prepared as in Example 1 was weighed and a coating emulsion was prepared in the same manner as in Example 1, except that 120 ml of a 0.05% solution of a sensitizing dye of formula (I) as shown in Table 3 below was first added and thereafter, 42 ml of a 0.5% methanol solution of a compound of formula (III) also as shown in Table 3 was added. The coating emulsion thus-formed was coated on a polyester support in an amount of 3.7 g/m$^2$ (i.e., the amount converted to silver), the amount of gelatin coated being 2.0 g/m$^2$.

A protective layer, a backing layer and a backing protective layer were prepared and coated in the same manner as in Example 1. The photographic material samples thus-prepared were exposed, processed and subjected to sensitometry also in the same manner as in Example 1.

The results obtained are shown in Table 3.

TABLE 3

| Sample No. | Sensitizing Dye Added | Amount of Sensitizing Dye Added (ml/kg of emulsion) | Compound of Formula (III) | Sensitivity | Fog |
|---|---|---|---|---|---|
| 3-1 | I-7 | 70 | — | 100 (standard) | 0.05 |
| 3-2 | I-7 | 105 | — | 81 | 0.06 |
| 3-3 | I-7 | 70 | III-3 | 589 | 0.05 |
| 3-4 | I-7 | 105 | III-3 | 631 | 0.05 |
| 3-5 | I-12 | 70 | — | 100 (standard) | 0.05 |
| 3-6 | I-12 | 105 | — | 76 | 0.05 |
| 3-7 | I-12 | 70 | III-3 | 603 | 0.05 |
| 3-8 | I-12 | 105 | III-3 | 661 | 0.05 |
| 3-9 | I-13 | 70 | — | 100 (standard) | 0.05 |
| 3-10 | I-13 | 105 | — | 78 | 0.05 |
| 3-11 | I-13 | 70 | III-3 | 537 | 0.05 |
| 3-12 | I-13 | 105 | III-3 | 741 | 0.04 |
| 3-13 | I-16 | 70 | — | 100 (standard) | 0.05 |
| 3-14 | I-16 | 105 | — | 65 | 0.05 |
| 3-15 | I-16 | 70 | III-3 | 617 | 0.04 |
| 3-16 | I-16 | 105 | III-3 | 708 | 0.04 |
| 3-17 | I-20 | 70 | — | 100 (standard) | 0.05 |
| 3-18 | I-20 | 105 | — | 58 | 0.05 |
| 3-19 | I-20 | 70 | III-3 | 316 | 0.05 |
| 3-20 | I-20 | 105 | III-3 | 363 | 0.05 |
| 3-21 | I-21 | 70 | — | 100 (standard) | 0.05 |
| 3-22 | I-21 | 105 | — | 55 | 0.05 |
| 3-23 | I-21 | 70 | III-3 | 389 | 0.05 |
| 3-24 | I-21 | 105 | III-3 | 372 | 0.05 |
| 3-25 | I-23 | 70 | — | 100 (standard) | 0.05 |
| 3-26 | I-23 | 105 | — | 59 | 0.05 |
| 3-27 | I-23 | 70 | III-3 | 324 | 0.05 |
| 3-28 | I-23 | 105 | III-3 | 302 | 0.05 |

As is apparent from the results in Table 3 above, it is understood that the sensitizing function of the sensitizing dyes of the present invention is increased by combination with the compounds of formula (III).

EXAMPLE 4

An emulsion was prepared in the same manner as in Example 1 except that the Br content was varied to 35 mol %. One kg of the emulsion was weighed, and 125 ml of a 0.05% methanol solution of a sensitizing dye of formula (I) as shown in Table 4 below, a 0.3% methanol solution of a compound of formula (II) also as shown in the Table 4, and 35 ml of a 0.5% methanol solution of compound (III-5) were added thereto. Then, 100 mg/m$^2$ of hydroquinone, polyethyl acrylate latex in an amount of 25% based on gelatin, and 85 mg/m$^2$ of 2-bis(vinylsulfonylacetamido)ethane were added thereto. The resulting composition was coated on a polyester support in an amount of 3.5 g/m$^2$ (i.e., the amount converted to silver), the amount of gelatin coated being 1.7 g/m$^2$.

A protective layer, a backing layer and a backing protective layer were prepared and coated in the same manner as in Example 1. The photographic material samples thus-prepared were exposed, processed and subjected to sensitometry also in the same manner as in Example 1.

The results obtained are shown in Table 4.

TABLE 4

| Sample No. | Sensitizing Dye of Formula (I) Added | Compound of Formula (II) Added | Amount of Compound of Formula (II) Added (ml/kg of emulsion) | Sensitivity | Fog |
|---|---|---|---|---|---|
| 4-1 | I-5 | — | — | 100 (standard) | 0.05 |
| 4-2 | I-5 | II-1 | 50 | 126 | 0.05 |
| 4-3 | I-5 | II-1 | 80 | 129 | 0.04 |
| 4-4 | I-5 | II-3 | 50 | 151 | 0.05 |
| 4-5 | I-5 | II-3 | 80 | 132 | 0.04 |
| 4-6 | I-5 | II-4 | 50 | 120 | 0.05 |
| 4-7 | I-5 | II-4 | 80 | 132 | 0.05 |
| 4-8 | I-5 | II-6 | 50 | 148 | 0.05 |
| 4-9 | I-5 | II-6 | 80 | 158 | 0.04 |
| 4-10 | I-5 | II-8 | 50 | 132 | 0.05 |
| 4-11 | I-5 | II-8 | 80 | 120 | 0.04 |
| 4-12 | I-5 | II-10 | 50 | 117 | 0.05 |
| 4-13 | I-5 | II-10 | 80 | 120 | 0.05 |
| 4-14 | I-5 | II-17 | 50 | 141 | 0.05 |
| 4-15 | I-5 | II-17 | 80 | 151 | 0.05 |
| 4-16 | I-12 | — | — | 100 (standard) | 0.05 |
| 4-17 | I-12 | II-2 | 50 | 123 | 0.05 |
| 4-18 | I-12 | II-2 | 80 | 126 | 0.04 |
| 4-19 | I-12 | II-7 | 50 | 138 | 0.05 |
| 4-20 | I-12 | II-7 | 80 | 148 | 0.04 |
| 4-21 | I-12 | II-9 | 50 | 129 | 0.05 |
| 4-22 | I-12 | II-9 | 80 | 120 | 0.04 |
| 4-23 | I-12 | II-11 | 50 | 132 | 0.05 |
| 4-24 | I-12 | II-11 | 80 | 120 | 0.05 |
| 4-25 | I-12 | II-15 | 50 | 120 | 0.05 |
| 4-26 | I-12 | II-15 | 80 | 117 | 0.05 |
| 4-27 | I-12 | II-16 | 50 | 138 | 0.05 |
| 4-28 | I-12 | II-16 | 80 | 129 | 0.04 |

As is apparent from the results of Table 4 above, it is understood that the sensitizing function of the sensitizing dyes of the present invention is increased further by combination with the compounds of formula (II) even in the presence of compounds of formula (III).

EXAMPLE 5

Some of the samples as prepared in Example 4 were stored under the conditions of 40° C. and 70% RH for 5 days and then exposed, processed and subjected to sensitometry in the same manner as in Example 1. The results obtained are shown in Table 5 below.

TABLE 5

| Experiment No. | Sample No. | Fresh Sample Sensitivity | Fresh Sample Fog | After Stored at 40° C., 70% RH for 5 days Sensitivity | After Stored at 40° C., 70% RH for 5 days Fog |
|---|---|---|---|---|---|
| 1 | 4-1 | 100 (standard) | 0.05 | 18.6 | 0.06 |
| 2 | 4-3 | 129 | 0.04 | 120 | 0.04 |
| 3 | 4-5 | 132 | 0.04 | 132 | 0.04 |
| 4 | 4-7 | 132 | 0.05 | 123 | 0.05 |
| 5 | 4-9 | 158 | 0.04 | 155 | 0.04 |
| 6 | 4-11 | 120 | 0.04 | 117 | 0.04 |
| 7 | 4-13 | 120 | 0.05 | 115 | 0.05 |
| 8 | 4-15 | 151 | 0.05 | 148 | 0.05 |
| 9 | 4-16 | 100 (standard) | 0.05 | 14.5 | 0.06 |
| 10 | 4-18 | 126 | 0.04 | 117 | 0.04 |
| 11 | 4-20 | 148 | 0.04 | 145 | 0.04 |
| 12 | 4-22 | 120 | 0.04 | 115 | 0.04 |
| 13 | 4-24 | 120 | 0.05 | 115 | 0.05 |
| 14 | 4-26 | 117 | 0.05 | 112 | 0.05 |
| 15 | 4-28 | 129 | 0.04 | 123 | 0.04 |

As is apparent from the results in Table 5 above, it is understood that the combination of the sensitizing dyes of the present invention and the compounds of formula (II) results in stable storage values under high temperature and high humidity conditions.

EXAMPLE 6

One kg of an emulsion as prepared in the same manner as in Example 4 was weighed, and 125 ml of a 0.05% methanol solution of a sensitizing dye of formula (I) as shown in Table 6 below, 35 ml of a 0.5% methanol solution of compound (II-3), and 60 ml of a 0.5% methanol solution of compound (II-6) were added thereto. Then, a 0.5% methanol solution of a compound of formula (III) as shown in Table 6 was added thereto. Further, 100 mg/m$^2$ of hydroquinone, polyethyl acrylate latex in an amount of 25% based on gelatin, and 85 mg/m$^2$ of 2-bis(vinylsulfonylacetamido)ethane were added thereto. The resulting composition was coated on a polyester support in an amount of 3.5 g/m$^2$ (e.g., the amount converted to silver), the amount of gelatin coated being 1.7 g/m$^2$. A protective layer, a backing layer and a backing protective layer were prepared and coated in the same manner as in Example 1. The photographic material samples thus-prepared were exposed, processed and subjected to sensitometry also in the same manner as in Example 1.

The results obtained are shown in Table 6.

TABLE 6

| Sample No. | Sensitizing Dye of Formula (I) Added | Compound of Formula (III) Added | Amount of Compound of Formula (III) Added (ml/kg of emulsion) | Sensitivity | Fog |
|---|---|---|---|---|---|
| 5-1 | I-13 | — | — | 100 (standard) | 0.05 |
| 5-2 | I-13 | III-1 | 30 | 380 | 0.05 |
| 5-3 | I-13 | III-1 | 60 | 417 | 0.04 |
| 5-4 | I-13 | III-3 | 30 | 427 | 0.05 |
| 5-5 | I-13 | III-3 | 60 | 490 | 0.04 |
| 5-6 | I-13 | III-5 | 30 | 324 | 0.05 |
| 5-7 | I-13 | III-5 | 60 | 437 | 0.05 |
| 5-8 | I-7 | — | — | 100 (standard) | 0.05 |
| 5-9 | I-7 | III-2 | 30 | 324 | 0.05 |
| 5-10 | I-7 | III-2 | 60 | 407 | 0.05 |
| 5-11 | I-7 | III-7 | 30 | 339 | 0.05 |
| 5-12 | I-7 | III-7 | 60 | 447 | 0.04 |
| 5-13 | I-7 | III-13 | 30 | 331 | 0.05 |
| 5-14 | I-7 | III-13 | 60 | 347 | 0.04 |
| 5-15 | I-14 | — | — | 100 (standard) | 0.05 |
| 5-16 | I-14 | III-4 | 30 | 355 | 0.05 |
| 5-17 | I-14 | III-4 | 60 | 437 | 0.04 |
| 5-18 | I-14 | III-9 | 30 | 355 | 0.05 |
| 5-19 | I-14 | III-9 | 60 | 407 | 0.05 |
| 5-20 | I-14 | III-11 | 30 | 324 | 0.04 |
| 5-21 | I-14 | III-11 | 60 | 389 | 0.04 |
| 5-22 | I-16 | — | — | 100 (standard) | 0.05 |
| 5-23 | I-16 | III-5 | 30 | 331 | 0.05 |
| 5-24 | I-16 | III-5 | 60 | 447 | 0.04 |
| 5-25 | I-16 | III-12 | 30 | 309 | 0.05 |
| 5-26 | I-16 | III-12 | 60 | 380 | 0.05 |
| 5-27 | I-16 | III-14 | 30 | 324 | 0.05 |
| 5-28 | I-16 | III-14 | 60 | 398 | 0.05 |

As is apparent from the results of Table 6 above, it is understood that the sensitizing function of the sensitizing dyes of the present invention is increased further by combination with the compounds of formula (III) even in the presence of compounds of formula (II).

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one sensitizing dye represented by formula (I):

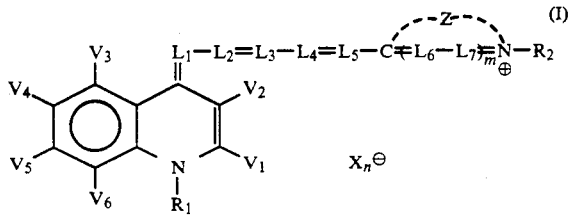

(I)

wherein $V_1$, $V_2$, $V_3$, $V_4$, $V_5$ and $V_6$ each represent a substituent satisfying the condition of:

$Y=\sigma p1+\sigma p2+\sigma p3+\sigma p4+\sigma p5+\sigma p6<-0.27$, and Hammett's $\sigma p$ value of each being $\sigma pi$ with i being from 1 to 6;

$R_1$ and $R_2$ may be the same or different and each represents an alkyl group;

$L_1$, $L_2$, $L_3$, $L_4$, $L_5$, $L_6$ and $L_7$ each represents a methine group, and m represents 0 or 1;

Z represents an atomic group necessary for forming a 5-membered or 6-membered nitrogen-containing hetero ring; and X represents a charge balancing counter ion, and n has a value of at least 0 which is necessary for neutralizing the charge of the compound.

2. The silver halide photographic material as claimed in claim 1, wherein the dye of formula (I) has two or more substituents $V_1$ to $V_6$, each with a $\sigma pi$ of less than 0 wherein i=1 to 6.

3. The silver halide photographic material as claimed in claim 1, wherein $\sigma p4$ is less than 0 and $\sigma p5$ is less than 0.

4. The silver halide photographic material as claimed in claim 1, wherein the sensitizing dye represented by formula (I) is present in a silver halide emulsion layer, and wherein the material further comprises a light-insensitive hydrophilic colloid layer having an optical density of at least 0.5 at a wavelength of 780 nm, said colloid layer being located on the side of the support opposite to the silver halide emulsion layer containing the sensitizing dye represented by formula (I).

5. The silver halide photographic material as claimed in claim 1, wherein the sensitizing dye represented by formula (I) is present in a silver halide emulsion layer, and wherein the material further comprises a light-insensitive hydrophilic colloid layer having an optical density of at least 0.5 at a wavelength of 780 nm, said colloid layer being located between the support and the silver halide emulsion layer containing the sensitizing dye represented by formula (I).

6. The silver halide photographic material as claimed in claim 4, wherein the material further comprises a light-insensitive hydrophilic colloid layer having an optical density of at least 0.5 at a wavelength of 780 nm, said colloid layer being located between the support and the silver halide emulsion layer containing the sensitizing dye represented by formula (I).

7. The silver halide photographic material as claimed in claim 1, which further comprises at least one compound represented by formula (II):

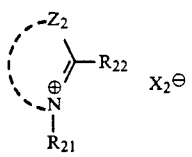

(II)

wherein $Z_2$ represents a non-metallic atomic group necessary for forming a 5-membered or 6-membered nitrogen-containing hetero ring;

$R_{21}$ represents a hydrogen atom, an alkyl group or an alkenyl group;

$R_{22}$ represents a hydrogen atom or a lower alkyl group; and $X_2$ represents an acid anion.

8. The silver halide photographic material as claimed in claim 1, which further comprises at least one compound represented by formula (III):

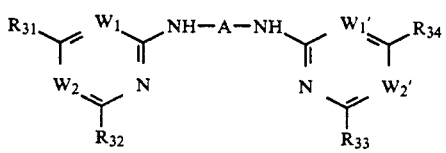

(III)

wherein A represents a divalent aromatic group;

$R_{31}$, $R_{32}$, $R_{33}$ and $R_{34}$ may be the same or different, and each represents a hydrogen atom, a hydroxyl group, a lower alkyl group, an alkoxy group, an aryloxy group, a halogen atom, a heterocyclic group, an alkylthio group, a heterocyclic-thio group, an arylthio group, an amino group, an alkylamino group, an arylamino group, a heterocyclic amino group, an aralkylamino group, an aryl group, or a mercapto group; and $W_1$ and $W_2$, and $W_1'$ and $W_2'$ each represents —HC= or —N=, provided that at least one of $W_1$ and $W_2$ is —N= and at least one of $W_1'$ and $W_2'$ is —N=.

9. A method for forming an image from a silver halide photographic material comprising the steps of imagewise exposing a silver halide photographic material and developing the exposed silver halide photographic material, said silver halide photographic material comprising at least one sensitizing dye represented by formula (I):

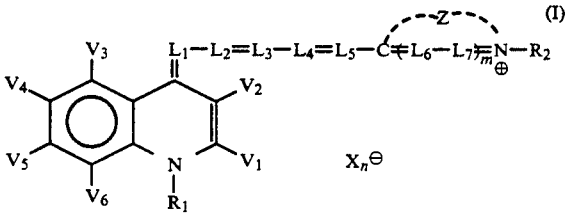

(I)

wherein $V_1$, $V_2$, $V_3$, $V_4$, $V_5$ and $V_6$ each represents a substituent satisfying the condition of:

$Y = \sigma p1 + \sigma p2 + \sigma p3 + \sigma p4 + \sigma p5 + \sigma p6 < -0.27$, and Hammett's $\sigma p$ value of each being $\sigma pi$ with i being from 1 to 6;

$R_1$ and $R_2$ may be the same or different and each represents an alkyl group;

$L_1$, $L_2$, $L_3$, $L_4$, $L_5$, $L_6$ and $L_7$ each represents a methine group, and m represents 0 or 1;

Z represents an atomic group necessary for forming a 5-membered or 6-membered nitrogen-containing hetero ring; and X represents a charge balancing counter ion, and n has a value of at least 0 which is necessary for neutralizing the charge of the compound.

10. The method for processing a silver halide photographic material as claimed in claim 9, wherein the silver halide photographic material is developed at a period of 60 seconds or less from the start of development to the finish of drying and/or developed at a linear speed of 1500 mm/min or more.

11. The silver halide photographic material as claimed in claim 1, wherein said sensitizing dye represented by formula (I) is contained in a silver halide photographic emulsion in an amount of from $5 \times 10^{-7}$ mol to $5 \times 10^{-3}$ mol per mol of silver halide in the emulsion.

12. The silver halide photographic material as claimed in claim 7, wherein said compound represented by formula (II) is contained in a silver halide photographic emulsion in an amount of from 0.01 g to 5 g per mol of silver halide in the emulsion.

13. The silver halide photographic material as claimed in claim 8, wherein said compound represented by formula (III) is contained in a silver halide photographic emulsion in an amount of from 0.01 g to 5 g per mol of silver halide in the emulsion.

* * * * *